US011324340B2

(12) United States Patent
Wills et al.

(10) Patent No.: US 11,324,340 B2
(45) Date of Patent: May 10, 2022

(54) MODULAR PUSHER TRAY ASSEMBLY

(71) Applicant: Retail Space Solutions LLC, Milwaukee, WI (US)

(72) Inventors: Matthew Wills, Grafton, WI (US); Julia Padvoiskis, Milwaukee, WI (US)

(73) Assignee: Retail Space Solutions LLC, Mil waukee, WI (US)

( * ) Notice: Subject to any disclaimer, the term of this patent is extended or adjusted under 35 U.S.C. 154(b) by 0 days.

(21) Appl. No.: 16/783,415

(22) Filed: Feb. 6, 2020

(65) Prior Publication Data

US 2020/0253393 A1 Aug. 13, 2020

Related U.S. Application Data

(60) Provisional application No. 62/804,004, filed on Feb. 11, 2019, provisional application No. 62/804,012, filed on Feb. 11, 2019.

(51) Int. Cl.

| | |
|---|---|
| ***A47F 1/12*** | (2006.01) |
| ***A47F 7/00*** | (2006.01) |
| ***A47F 5/00*** | (2006.01) |
| ***A47B 57/58*** | (2006.01) |
| ***A47F 5/08*** | (2006.01) |

(52) U.S. Cl.

CPC ..... *A47F 1/126* (2013.01); *A47B 57/585* (2013.01); *A47F 5/005* (2013.01); *A47F 5/0846* (2013.01); *A47F 7/0007* (2013.01); *A47B 2220/0002* (2013.01); *A47B 2220/0022* (2013.01)

(58) Field of Classification Search

CPC ..... A47F 1/126; A47F 7/0007; A47F 5/005; A47B 57/585; A47B 57/0846

See application file for complete search history.

(56) References Cited

U.S. PATENT DOCUMENTS

| | | | |
|---|---|---|---|
| 4,856,658 | A | 8/1989 | Novak |
| 4,874,099 | A | 10/1989 | Arnott et al. |
| 4,907,707 | A | 3/1990 | Crum |
| 5,012,936 | A | 5/1991 | Crum |
| 5,123,546 | A | 6/1992 | Crum |
| 5,366,099 | A | 11/1994 | Schmid |
| 5,665,304 | A | 9/1997 | Heinen |
| 5,746,328 | A | 5/1998 | Beeler et al. |

(Continued)

FOREIGN PATENT DOCUMENTS

| | | | |
|---|---|---|---|
| WO | WO 2014135594 | A1 | 9/2014 |
| WO | WO 2018200997 | A1 | 11/2018 |

OTHER PUBLICATIONS

Wills et al., "Adjustable-Width Pusher Tray Assembly," Unpublished U.S. Appl. No. 16/783,410, filed Feb. 6, 2020.

*Primary Examiner* — Stanton L Krycinski

(74) *Attorney, Agent, or Firm* — Andrus Intellectual Property Law LLP

(57) ABSTRACT

A product display merchandiser includes a tray having a top product-supporting surface with a longitudinally extending channel defined therein. A first sidewall has a vertical portion and a horizontal portion, and at least a laterally inner part of the horizontal portion can slide laterally with respect to the tray between a bottom of the tray and a base plate below the tray. A front end of the tray has a fitting received in a socket in the base plate. At a rear end of the tray, the channel receives a support assembly that connects the tray to a support structure.

18 Claims, 19 Drawing Sheets

(56) References Cited

U.S. PATENT DOCUMENTS 5,769,248 A 6/1998 Johnson
5,855,283 A 1/1999 Johnson
6,227,385 B1 5/2001 Nickerson
6,352,162 B1 3/2002 Yang et al.
6,357,606 B1 3/2002 Henry
6,719,152 B1 4/2004 Nagel et al.
6,745,906 B1 6/2004 Nagel
6,866,156 B2 3/2005 Nagel et al.
6,886,700 B2 5/2005 Nagel
6,889,854 B2 5/2005 Burke
7,168,579 B2 1/2007 Richter et al.
7,201,281 B1 4/2007 Welker
7,246,711 B1 7/2007 Metcalf
7,458,473 B1 12/2008 Mason
7,681,744 B2 3/2010 Johnson
7,681,745 B2 3/2010 Richter
7,703,614 B2 4/2010 Schneider et al.
8,066,128 B2 11/2011 Crawbuck et al.
8,186,520 B2 * 5/2012 Schneider ..... A47F 1/126 211/59.3
8,317,038 B2 11/2012 Luberto et al.
8,453,851 B2 6/2013 Ciesick
8,893,901 B2 11/2014 Nagel
9,016,484 B2 4/2015 Kologe
9,038,833 B2 * 5/2015 Ciesick ..... A47F 1/126 211/59.3
9,055,828 B2 6/2015 Burchell
9,101,230 B2 8/2015 Sosso et al.
9,138,076 B2 9/2015 Hardy
9,392,885 B2 7/2016 Vogler
9,408,478 B2 8/2016 Volger et al.
9,486,090 B2 11/2016 Juric
9,521,913 B2 12/2016 Vogler
9,629,479 B2 4/2017 Sosso et al.
9,629,480 B2 4/2017 Ewing et al.
9,642,475 B2 5/2017 Volger et al.
9,713,394 B1 7/2017 Bruegmann
9,801,466 B2 10/2017 Hardy
9,901,191 B1 2/2018 Schmidt
9,986,852 B2 6/2018 Chenoweth et al.
10,034,557 B1 7/2018 Nagel
10,154,739 B2 12/2018 Turner et al.
10,219,639 B2 3/2019 Howard et al.
10,251,494 B1 * 4/2019 Nagel ..... A47F 5/005
10,278,519 B2 5/2019 Schmidt
10,334,967 B2 7/2019 Mercier et al.
10,357,118 B2 7/2019 Swafford
10,441,093 B2 * 10/2019 Chenoweth ..... A47F 5/0093
10,492,627 B2 * 12/2019 Nagel ..... A47B 57/58
10,952,548 B2 * 3/2021 Pollpeter ..... A47F 3/001
2003/0217980 A1 11/2003 Johnson et al.
2005/0077259 A1 4/2005 Menz
2005/0139560 A1 6/2005 Whiteside et al.
2006/0186065 A1 8/2006 Ciesick
2008/0237164 A1 10/2008 Davidson et al.
2009/0008406 A1 1/2009 Vardaro et al.
2009/0223916 A1 * 9/2009 Kahl ..... A47F 1/12 211/85.4
2010/0025346 A1 2/2010 Crawbuck et al.
2010/0107670 A1 5/2010 Kottke et al.
2014/0319086 A1 * 10/2014 Sosso ..... A47F 1/125 211/59.3
2015/0230628 A1 * 8/2015 Juric ..... A47F 1/12 211/59.2
2015/0257550 A1 9/2015 Burchell
2017/0202369 A1 7/2017 Mercier et al.
2017/0273477 A1 9/2017 Mercier et al.
2018/0035825 A1 2/2018 Pollpeter et al.
2018/0110345 A1 4/2018 Sun
2018/0153313 A1 6/2018 Padvoiskis et al.
2018/0325285 A1 11/2018 Hardy
2018/0354532 A1 12/2018 Vogler et al.
2018/0360233 A1 12/2018 Turner et al.
2019/0357701 A1 11/2019 Wills et al.
2020/0093282 A1 3/2020 Bruegmann

* cited by examiner

MODULAR PUSHER TRAY ASSEMBLY

CROSS-REFERENCE TO RELATED APPLICATIONS

This application claims the benefit of U.S. Provisional Application Ser. No. 62/804,012 and U.S. Provisional Application Ser. No. 62/804,004, both filed Feb. 11, 2019, and both of which are hereby incorporated by reference herein in their entireties.

FIELD

The present disclosure relates to product support and display systems.

BACKGROUND

U.S. Pat. No. 5,769,248 discloses a product display grid system including a grid and various product hangers. The grid is comprised of spaced vertical and spaced horizontal members. The product hangers such as shelves, cups, hook and trays have attachment members that secure the product hangers to the horizontal elongate members of the grid. The product hangers support and display the products.

U.S. Pat. No. 5,855,283 discloses a product display including a track, a tray having a top surface upon which products are displayed, and interengagable members on the track and tray for enabling the tray to have a first mode of operation wherein the interengagable members are disengaged allowing the tray to move relative to the track and a second mode of operation wherein the interengagable members are interengaged prohibiting movement of the tray relative to the track. A biasing member urges products on the displayed toward the front of the display. Adjustable guide members are positioned adjacent the display surface for containing products on the display surface. The guide members are adjustable to accommodate various sizes of products.

U.S. Pat. No. 6,227,385 discloses a self-facing, add-on shelf system made up of universal base, divider, front, and rear sections. Universal in the sense that these sections form basic building sections for constructing shelf systems of various sizes and operational mode. The front and rear track sections are identical and can be combined with various combinations of bases, dividers and end sections to provide systems of different, desired widths. The depth of the self-facing shelf is generally set by the depth of the shelf with which it is to be used. The individual sections can be selected and combined to provide center pusher, side pusher, and gravity feed types of self facing systems. The bases, dividers and end sections are configured such that they can be extruded and interlock in assembly.

U.S. Pat. Nos. 7,168,579 and 7,681,745 disclose merchandising systems providing for the presentation and storage of articles comprising a base having a front and a back, the base being configured to support the articles and defining a first space for containing the articles. In addition, the merchandising system comprises an assembly for advancing the articles toward the front of the base, wherein the assembly comprises a member configured to extend beyond the base to create a second space for containing the articles in addition to the first space.

U.S. Pat. No. 7,681,744 discloses a merchandising system for articles comprising a base comprising an upper surface having a plurality of ribs, an underside having a plurality of supports formed integrally with the underside of the base, and a first side and a second side. The merchandising system comprises a frame coupled to the base and configured to couple with a shelving system for supporting the base in a substantially horizontal configuration, a first guide and a second guide coupled to the base for supporting articles, and an assembly for advancing the articles that is coupled to the base and provides force on the articles.

U.S. Pat. No. 10,154,739 discloses a universal front-facing merchandiser having a front rail having a first mating structure and a plurality of integrated pusher and divider assemblies. Each divider assembly includes a second mating structure that corresponds to and mates with the first mating structure to couple the integrated pusher and divider assemblies to the front rail. The mating structures of each pusher and divider assembly and the front rail are movable between a first position where the integrated pusher and divider assembly is coupled to and laterally movable about the front rail and is not removable from the front rail without force being applied to the integrated pusher and divider assembly and a second position where the integrated pusher and divider assembly is secured to the front rail in a desired position in a manner that hinders lateral movement of the integrated pusher and divider assembly.

U.S. Patent Application Publication No. 2018/0153313 discloses a shelf management system having a tray defining a first mating structure and a second mating structure, a shelf management component having a spring biased pusher connected thereto and movable between a first position wherein the pusher is extended to a rear of the shelf management component and a second position wherein the pusher is retracted to a front of the shelf management component, and an interstitial member positioned between the shelf management component and the tray to secure the shelf management component to the tray and hinder lateral movement of the shelf management component with respect to the tray. Improved components of the shelf management system are also disclosed as are methods relating to same.

U.S. Patent Application Publication No. 2018/0360233 discloses a product display tray including one or more arms including engagement members. The product display tray can also include a base having one or more tracks receiving the one or more arms, wherein the base is slidable along the one or more arms from a first position to a second position. The product display tray can also include a handle. The product display tray can also include a latch, wherein the latch is operably connected to the handle, wherein the latch has an engaged position and a disengaged position, and wherein the latch is in the engaged position when the base is in the first position and the base is operable to enter the second position when the latch is in the disengaged position.

International Application Publication No. WO 2018/200997 discloses a product display comprising a rail having a channel and a tray. The tray comprising a first sidewall, a second sidewall, and a product support surface. The tray further comprising an engagement portion having at least one protrusion configured to engage the channel.

U.S. Patent Application Publication No. 2019/0357701 discloses a product display merchandiser comprising a tray having a product supporting surface; a first sidewall adjacent a first side of the tray; a second sidewall adjacent a second side of the tray; and a bracket configured to detachably mount the product display merchandiser to a support. The product display merchandiser is further configured with at least one of the following: the first and second sidewalls each having a respective sidewall vertical portion with a rear edge that is angled away from a rear of the product display merchandiser; the bracket having a tray-supporting portion that is oriented at an acute angle with respect to a support-engaging portion; and/or the bracket having at least two types of engagement members for mounting the product display merchandiser to either of at least two types of supports.

Each of the above patents and applications is hereby incorporated herein by reference in its entirety.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one example, a product display merchandiser comprises a tray having a top product-supporting surface with a longitudinally extending channel defined therein. A first sidewall has a vertical portion and a horizontal portion, at least a laterally inner part of the horizontal portion configured to slide laterally with respect to the tray between a bottom of the tray and a base plate below the tray. A front end of the tray comprises a fitting configured to be received in a socket in the base plate. At a rear end of the tray, the channel is configured to receive a support assembly configured to couple the tray to a support structure.

According to another example, a product display merchandiser comprises a tray subassembly comprising a tray having a top product-supporting surface and a longitudinally extending channel recessed from the product-supporting surface. A base plate is coupled to a bottom of the tray subassembly. A sidewall subassembly comprises first and second sidewalls, each sidewall having a vertical portion and a horizontal portion, at least a laterally inner part of each horizontal portion slidably extending between the bottom of the tray and a top of the base plate. A support subassembly is configured to couple the product display merchandiser to a support structure, the support subassembly comprising a support member located within the channel of the tray and a bracket.

BRIEF DESCRIPTION OF DRAWINGS

Examples of pusher tray systems are described with reference to the following Figures. The same numbers are used throughout the Figures to reference like features and like components.

DETAILED DESCRIPTION

In the present description, certain terms have been used for brevity, clarity, and understanding. No unnecessary limitations are to be implied therefrom beyond the requirement of the prior art because such terms are used for descriptive purposes only and are intended to be broadly construed.

Figure 1:
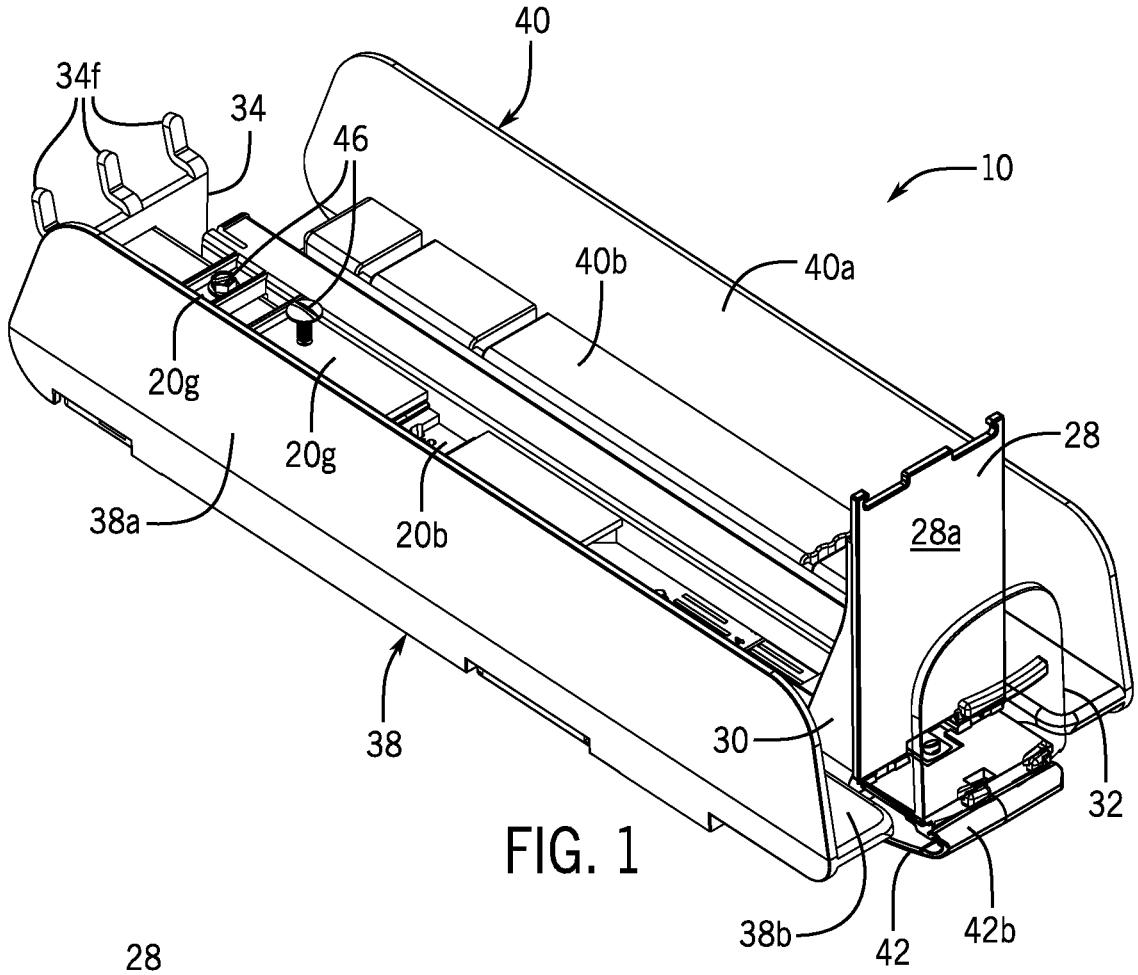
FIG. 1 illustrates a front perspective view of a product display merchandiser according to the present disclosure.
Figure 2:
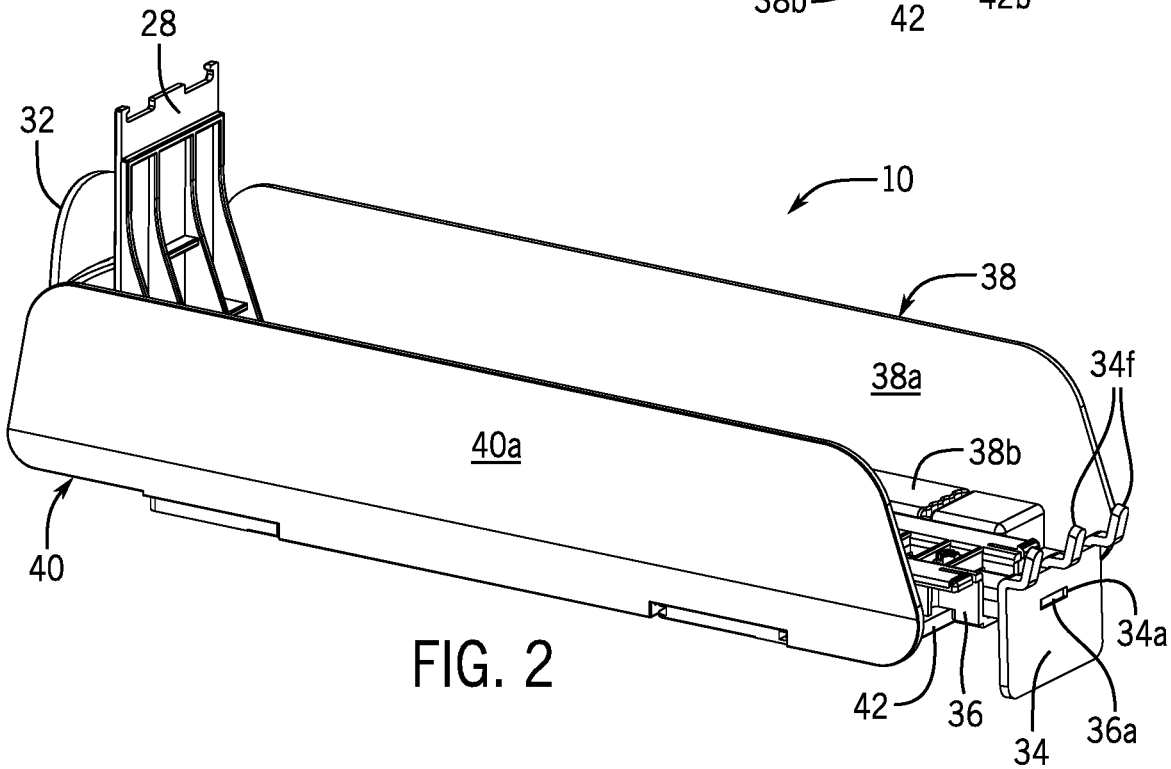
FIG. 2 illustrates a rear perspective view of the product display merchandiser.
Figure 3:
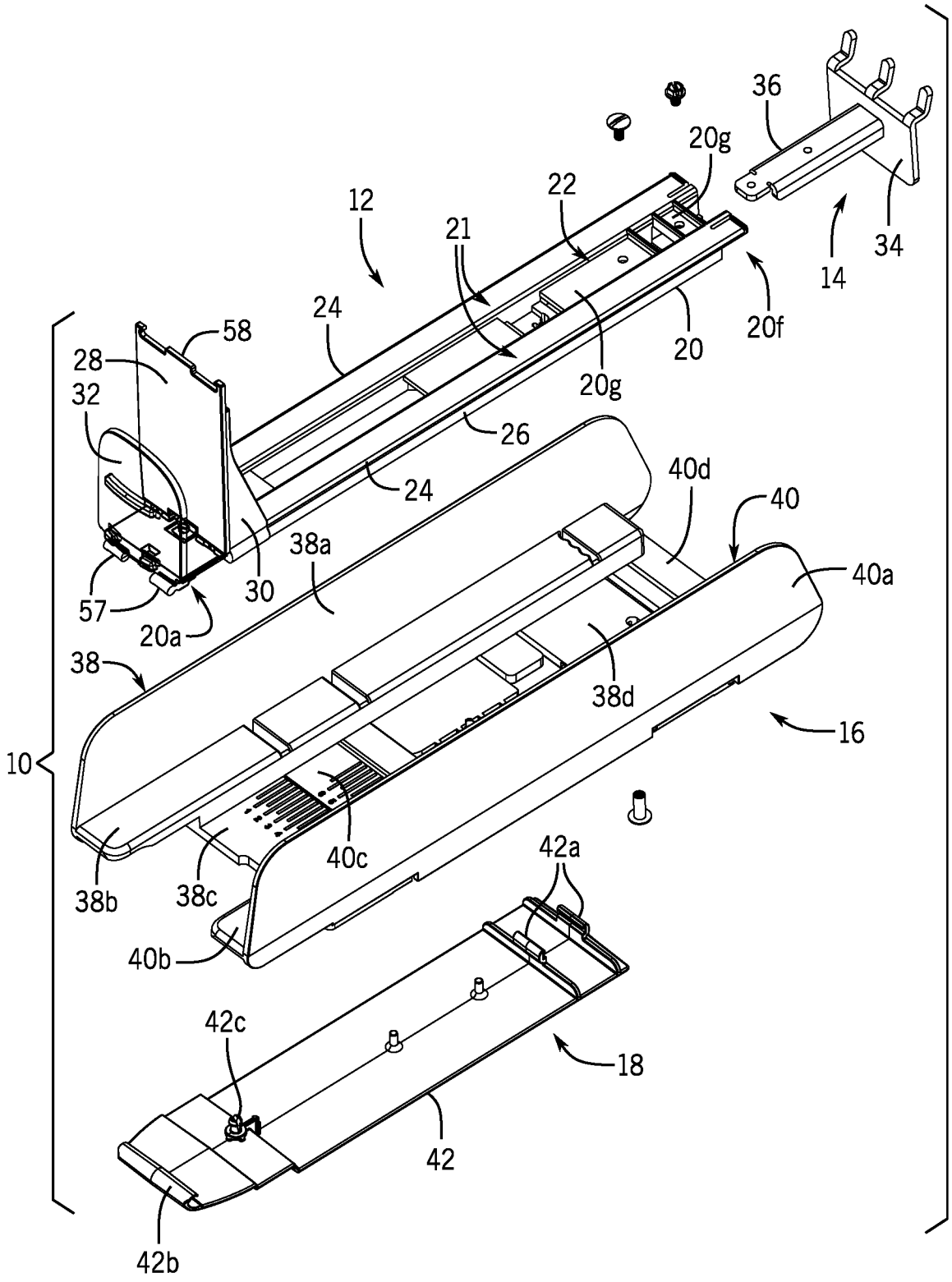
FIG. 3 illustrates a partially exploded view of the product display merchandiser.

FIGS. 1-3 illustrate a product display merchandiser 10 according to the present disclosure. Referring to FIG. 3, the product display merchandiser 10 is made up of four subassemblies, including a pusher subassembly 12, a support subassembly 14, a sidewall subassembly 16, and a base subassembly 18.

The pusher subassembly 12 includes a tray 20 having a top product-supporting surface 21 with a longitudinally extending channel 22 defined therein, the channel 22 being recessed from the product-supporting surface 21. On either lateral side of the tray 20 are slideways 24, the upper surfaces of which define the product-supporting surface 21, and the outer edges of which overhang supporting walls 26 on the underside of the tray 20. A pusher 28 has two sidewalls 30, the bottom ends of which are formed as inwardly-facing channels to receive the overhanging outer edges of the slideways 24, thereby engaging the pusher 28 with the tray 20. A spring (44, FIG. 4) is recessed in the channel 22 and coiled behind the pusher 28, which is longitudinally slidable along the tray 20 and configured to push product stocked in the tray 20 toward a product stop 32 located at a front end 20*a* of the tray 20. The product stop 32 (e.g., lens) is positioned in front of the pusher 28, and is held to the front end 20*a* of the tray 20 by way of a snap fit, although other types of attachments could be used. Product supported by the product-supporting surface 21 of the tray 20 is received on a front face 28*a* of the pusher 28, behind the product stop 32. As product is removed from the product display merchandiser 10, the spring-biased pusher 28 moves toward the front end 20*a* of the tray 20. More specifically, when product is removed from between the pusher 28 and the product stop 32, the spring 44 forces the pusher 28 toward the front end 20*a* of the tray 20, while the channels at the bottom ends of pusher sidewalls 30 slide along outer edges of slideways 24.

Referring to FIG. 3, the support subassembly 14 is configured to couple the tray 20 to a support structure, such as a peg/slat wall, and includes a bracket 34 and a support member 36. In this example, the support member 36 is a C-shaped member that opens downwardly; however, other structural cross-sections could be used. In this example, as shown in FIG. 2, the support member 36 is connected to the bracket 34 by way of a horizontally projecting tab 36*a* at the rear end of the support member 36, which extends into a slot 34*a* in the bracket 34 and is welded, adhered, or otherwise attached to the bracket 34. In other examples, the bracket 34 and support member 36 could be a single, integral piece.

As shown in FIG. 3, the sidewall subassembly 16 includes two sidewalls 38, 40, each of which includes a vertical portion 38*a*, 40*a* and a horizontal product-supporting portion 38*b*, 40*b*. As will be described further herein below, each of the first and second sidewalls 38, 40 also includes horizontally projecting tabs 38*c*, 38*d*, 40*c*, 40*d* located laterally inwardly of the product-supporting portions 38*b*, 40*b*, which tabs interface with one another such that a user can pull the vertical portions 38*a*, 40*a* toward one another or push the vertical portions 38*a*, 40*a* away from one another in order to accommodate products of differing widths. As shown in FIGS. 1 and 2, when the first and second sidewalls 38, 40 are coupled to the tray 20, with the first sidewall 38 adjacent a first lateral side of the tray 20 and the second sidewall 40 adjacent a second lateral side of the tray 20, a laterally outer part of the horizontal portions of the sidewalls 38, 40 (i.e., product-supporting portions 38*b*, 40*b* between the vertical portions 38*a*, 40*a* and horizontally projecting tabs 38*c*, 38*d*, 40*c*, 40*d*) are level with the product-supporting surface 21 of the tray 20. In other examples, as will also be described further herein below, no horizontal product-supporting portions 38*b*, 40*b* are provided, and the horizontally projecting tabs 38*c*, 38*d*, 40*c*, 40*d* extend directly from the vertical portions 38*a*, 40*a* of the sidewalls 38, 40.

Referring back to FIG. 3, the base subassembly 18 includes a base plate 42 having retaining clips 42*a* at a rear end thereof and a socket 42*b* at a front end thereof. Another clip 42*c* projects from the upper surface of the base plate 42 between the front and rear ends thereof. The clips 42*a*, 42*c* and socket 42*b* connect the base subassembly 18 to the remainder of the product display merchandiser 10, as will be described further herein below.

Figure 4:
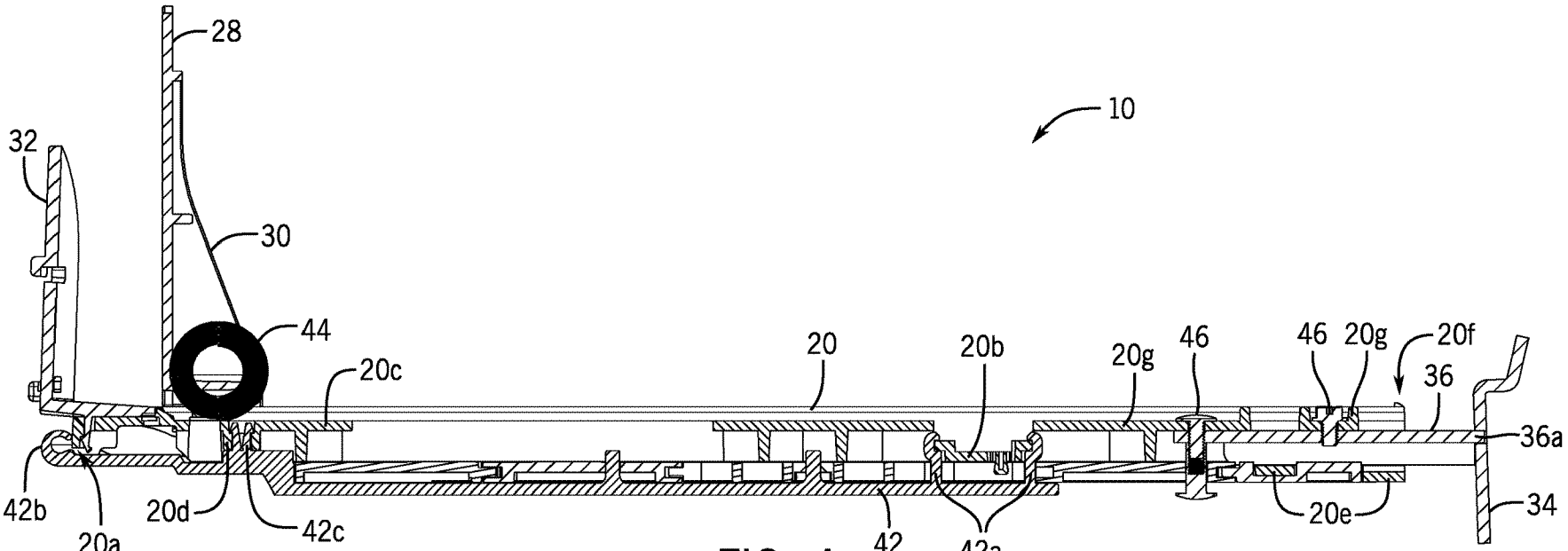
FIG. 4 is a cross-section of the product display merchandiser down a longitudinal centerline thereof, wherein no sidewalls are installed.

FIG. 4 illustrates a cross-section of parts of the product display merchandiser 10 down a longitudinal centerline thereof. The sidewall subassembly 16 is removed such that the interconnection of the pusher subassembly 12, support subassembly 14, and base subassembly 18 can be seen. Additionally, this view shows the spring 44 that biases the pusher 28 toward the front end 20*a* of the tray 20. As noted, the base plate 42 comprises upwardly projecting clips 42*a*, 42*c* for engaging receiving structures in the tray 20, such that the base plate 42 can be coupled to a bottom of the pusher subassembly 12. More specifically, the base plate 42 is snap-fit to the tray 20 by way of the clips 42*a* fitting around either end of a lower wall 20*b* of the tray 20. Additionally, clip 42*c* fits into a receiving boss 20*d* in lower wall 20*c* of tray 20. Clips 42*a*, 42*c* thereby connect the base subassembly 18 to the pusher subassembly 12. Socket 42*b* receives a fitting (see 57, FIGS. 1 and 8) at the front end 20*a* of tray 20, thereby further connecting the base subassembly 18 to the pusher subassembly 12.

Referring to FIGS. 3 and 4, at a rear end 20*f* of the tray 20, the channel 22 is configured to receive the support subassembly 14. As noted herein above, the support assembly 14 comprises a longitudinally extending support member 36 configured to be received/located in the channel 22 of the tray 20 and a bracket 34 extending non-parallel to the support member 36 and configured to detachably mount to a support structure. The channel 22 and support member 36 are sized and shaped such that the lateral sides of the support member 36 interference fit within the channel 22 and a top surface of the support member 36 does not extend above the product-supporting surface 21 of the tray 20. Ribs, including two upper ribs 20*g* and two lower ribs 20*e*, extend laterally within and across the channel 22 in the tray 20. The ribs 20*g*, 20*e* are configured to be coupled to the support assembly 14 when the support assembly 14 is received/located in the channel 22 of the tray 20. More specifically, upper ribs 20*g* are bolted to the support member 36 by way of bolts 46 (see also FIG. 1) and lower ribs 20*e* provide stability below the support member 36. The ribs 20*g*, 20*e* resist moments caused by loads on the ends 20*a*, 20*f* of the tray 20. Fewer or more ribs can be provided than those shown, and the support member 36 can be longer or shorter than shown depending on the loading requirements.

Figure 5:
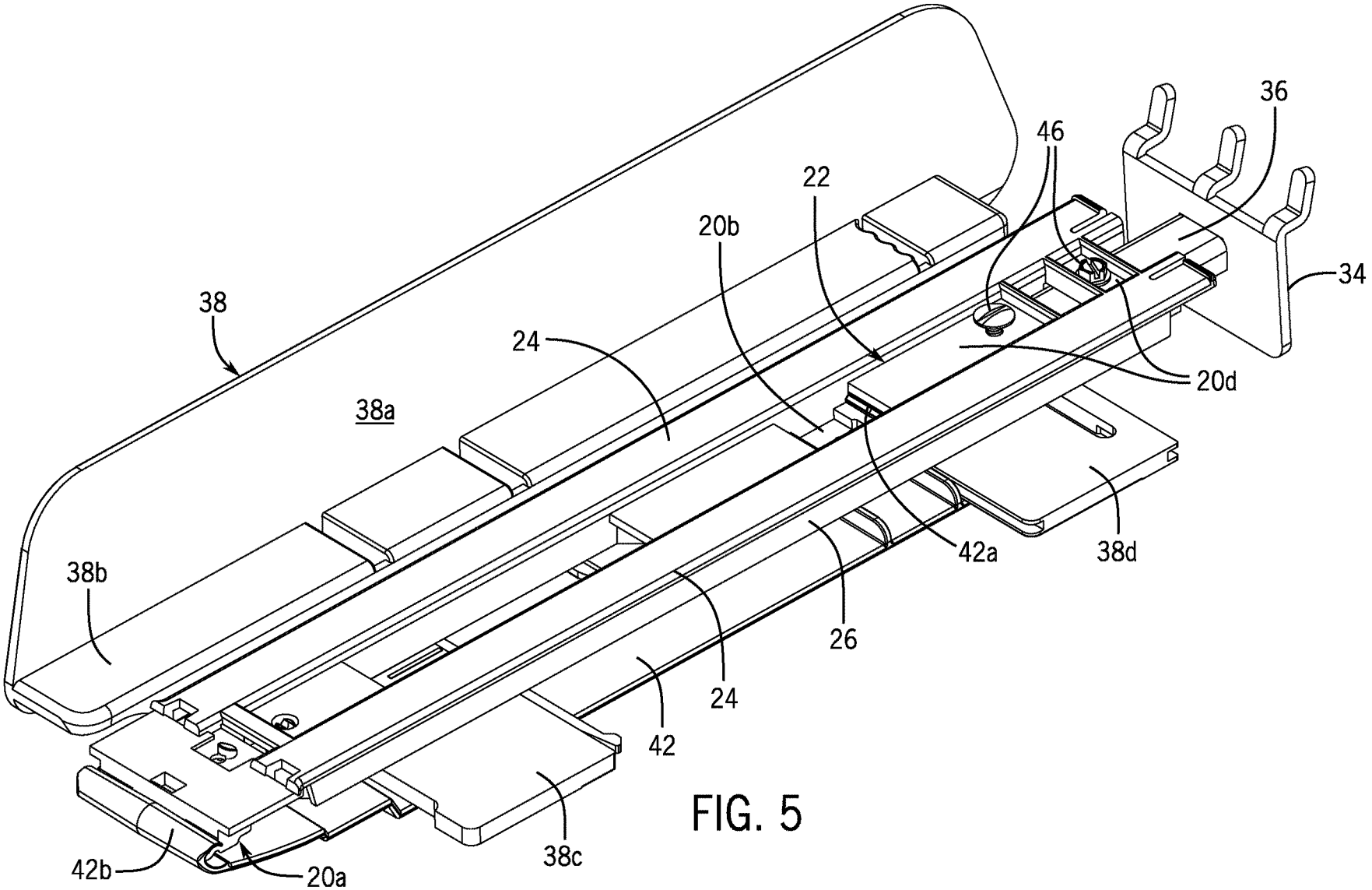
FIG. 5 is a partially assembled view of the product display merchandiser with a first sidewall.
Figure 6:
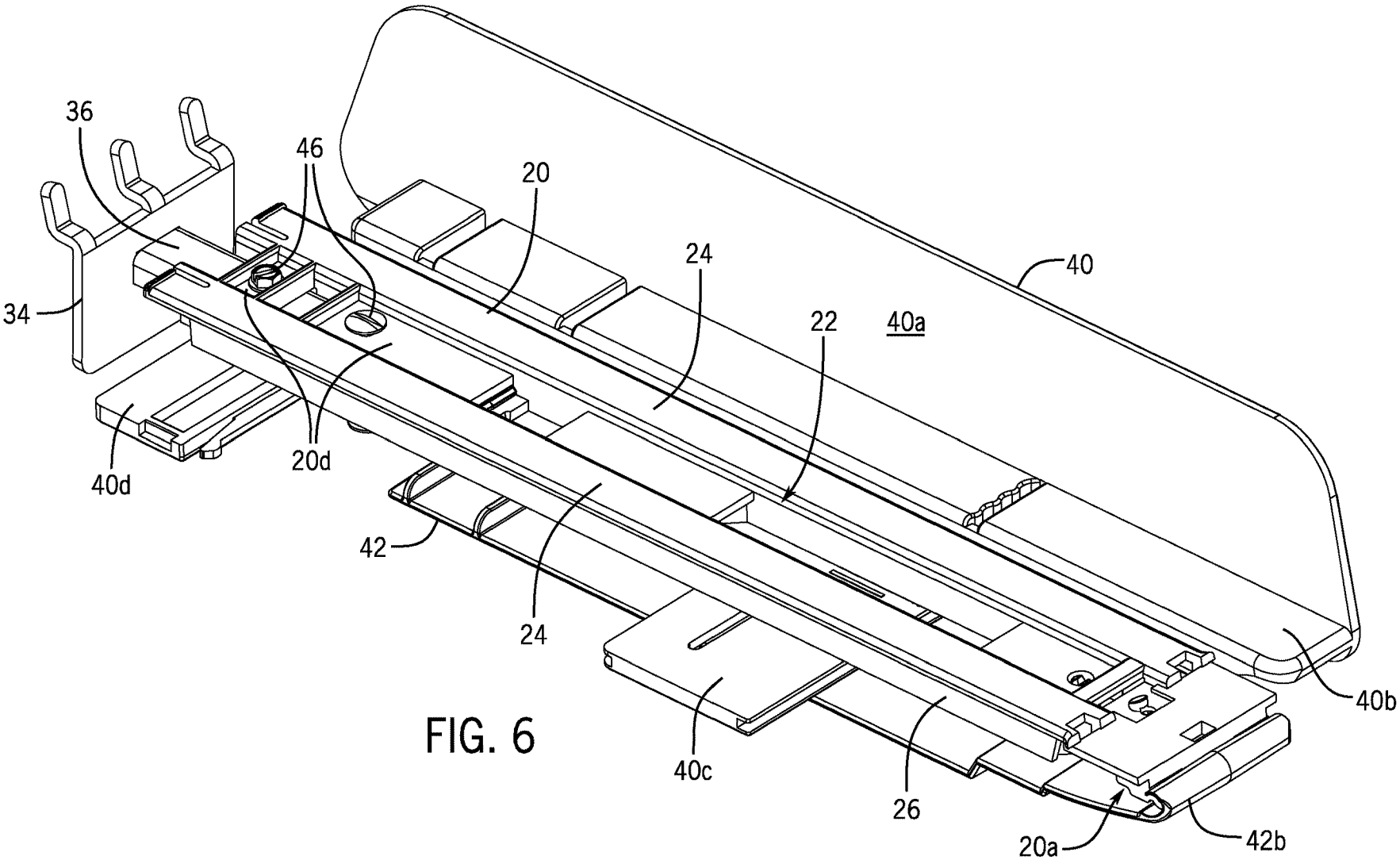
FIG. 6 is another partially assembled view of the product display merchandiser with a second sidewall.

FIG. 5 shows a portion of the product display merchandiser 10 from which the product stop 32, pusher 28, and the second sidewall 40 has been removed. The first sidewall 38 is installed to the base subassembly 18 and tray 20 by insertion of horizontally projecting tabs 38*c*, 38*d* extending from product-support portion 38*b* of sidewall 38 between a bottom of the tray 20 and a top of the base plate 42. FIG. 6 shows the opposite sidewall 40, which also has horizontally projecting tabs 40*c*, 40*d* extending from product-supporting portion 40*b*. Horizontally projecting tabs 40*c*, 40*d* also extend between the bottom of the tray 20 and the top of the base plate 42. Thus, the product display merchandiser 10 has a first sidewall 38 having a vertical portion 38*a* and a horizontal portion 38*b-d*, at least a laterally inner part of the horizontal portion (i.e., horizontally projecting tabs 38*c*, 38*d*) configured to slide laterally with respect to the tray 20 between a bottom of the tray 20 and the top of the base plate 42 below the tray 20. The product display merchandiser 10 further has a second sidewall 40 having a vertical portion 40*a* and a horizontal portion 40*b-d*, at least a laterally inner part of the horizontal portion (i.e., horizontally projecting tabs 40*c*, 40*d*) configured to slide laterally with respect to the tray 20 between the bottom of the tray 20 and the base plate 42 and to slidably engage with the horizontal portion (i.e., horizontally projecting tabs 40*c*, 40*d*) of the first sidewall 38. Specifically, horizontally projecting tabs 38*c*, 38*d*, 40*c*, 40*d* engage with one another in a manner that allows the sidewalls 38, 40 to slide toward and away from one another and with respect to the base subassembly 18 while remaining connected to one another and to the base subassembly 18, as will be described further herein below.

Figure 7:
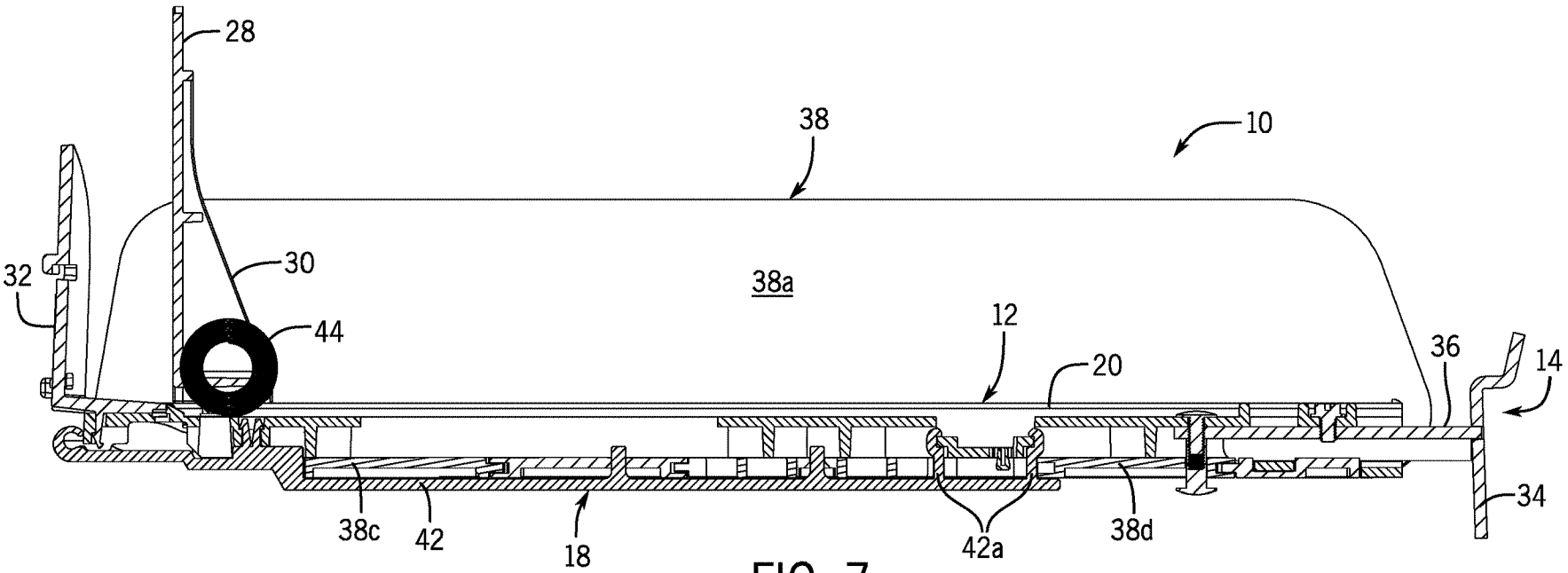
FIG. 7 is another cross-section of the product display merchandiser down the longitudinal centerline thereof, wherein the first sidewall is installed.

FIG. 7 illustrates a right side cross-sectional view of the product display merchandiser 10 with the first sidewall 38 installed and the second sidewall 40 removed. Similar to FIG. 4, it can be seen how the pusher subassembly 12, support subassembly 14, and base subassembly 18 are connected to one another. It can also be seen how the first sidewall 38 of the sidewall subassembly 16 is connected to the remainder of the parts by way of the horizontally projecting tabs 38*c* and 38*d* extending between the bottom of the tray 20 and the top of the base plate 42.

Figure 8:
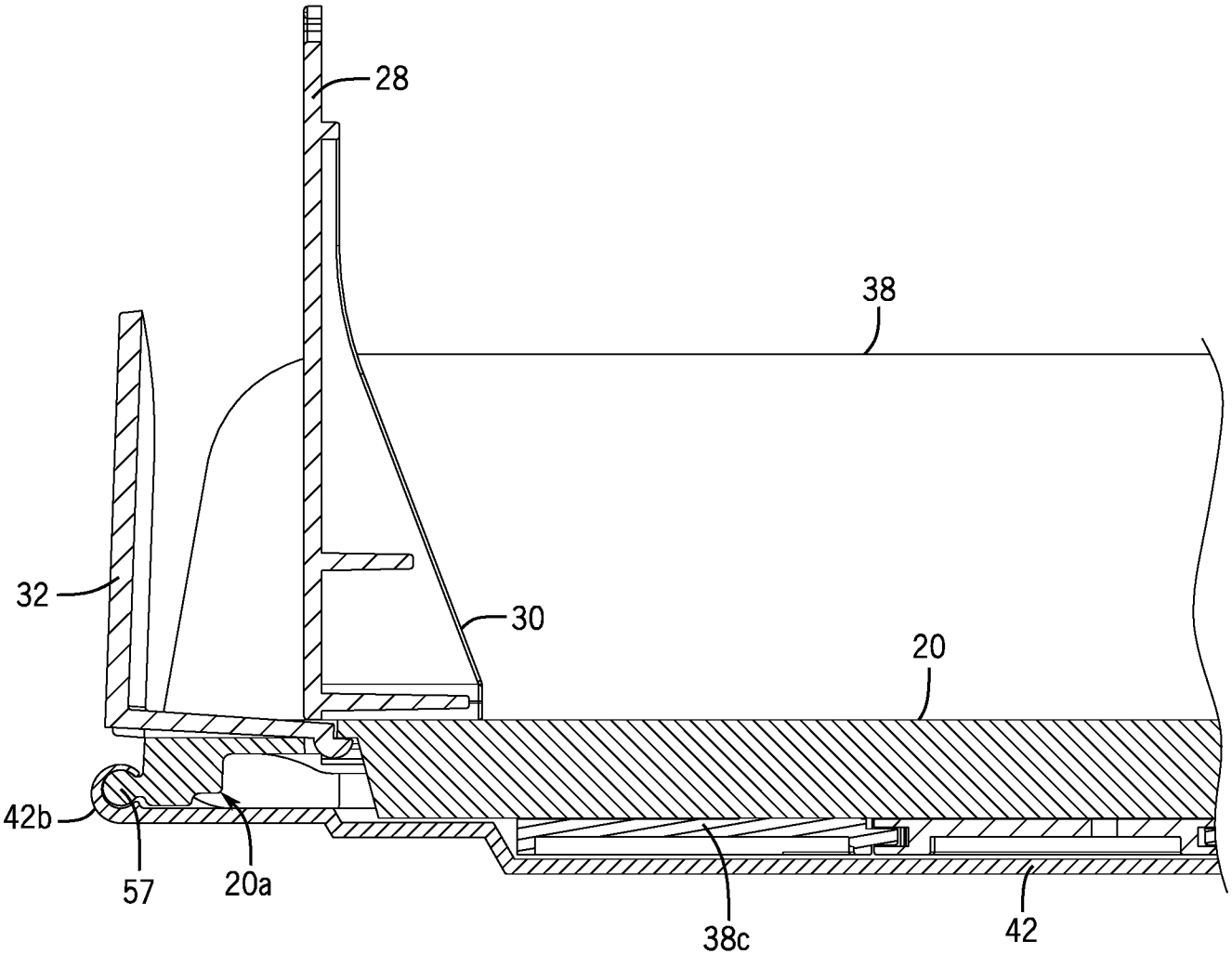
FIG. 8 illustrates a close-up cross-sectional view of a front end of the product display merchandiser.

FIG. 8 shows a close-up view of the front end of the product display merchandiser 10, taken through one of the fittings 57 at the front end 20*a* of the tray 20. As noted briefly herein above, the front end 20*a* of the tray 20 comprises a fitting 57 configured to be received in the socket 42*b* in the base plate 42. FIG. 3 shows how there may in fact be two fittings 57 at the front end 20*a* of the tray 20, although one or more than two fittings can be provided. Such a connection, in addition to the clip connections at 42*a*, 42*c* described hereinabove with respect to FIG. 4, further maintain the subassemblies in a fully assembled state.

Figure 9B:
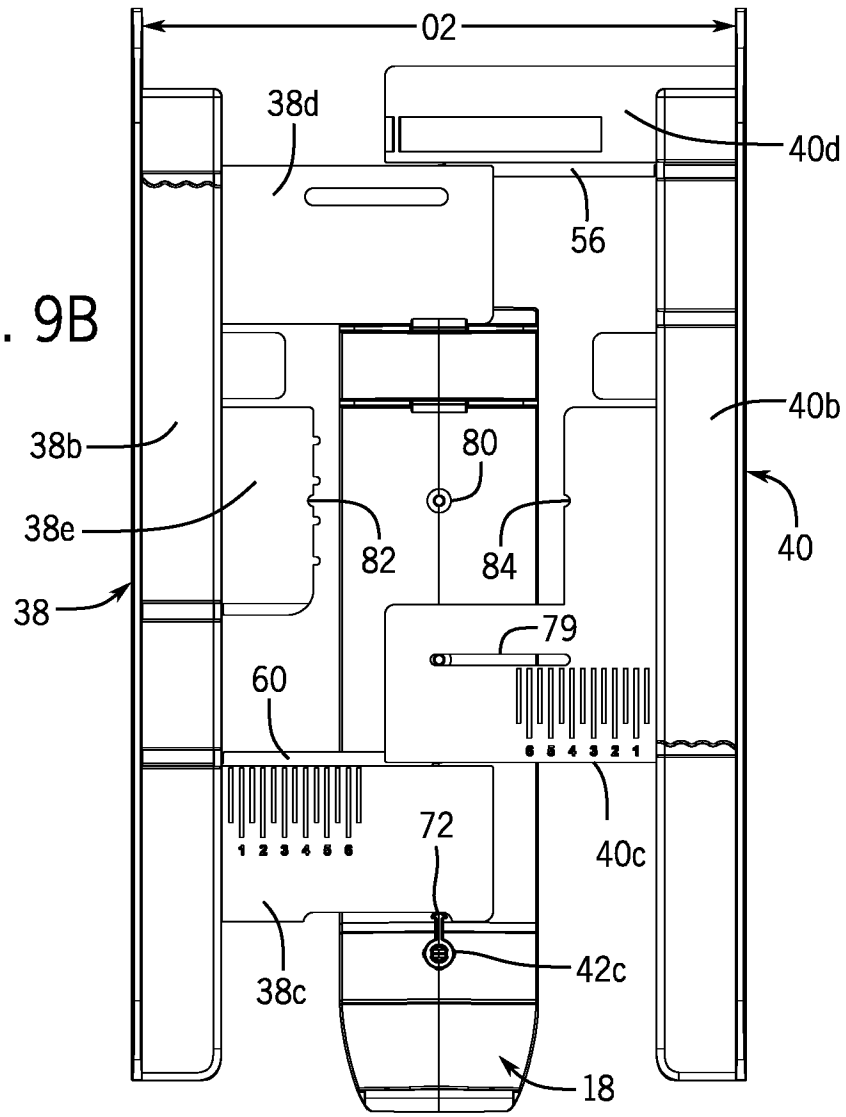
FIGS. 9A and 9B illustrate the sidewalls of the product display merchandiser in different positions with respect to the base plate thereof.
Figure 9A:
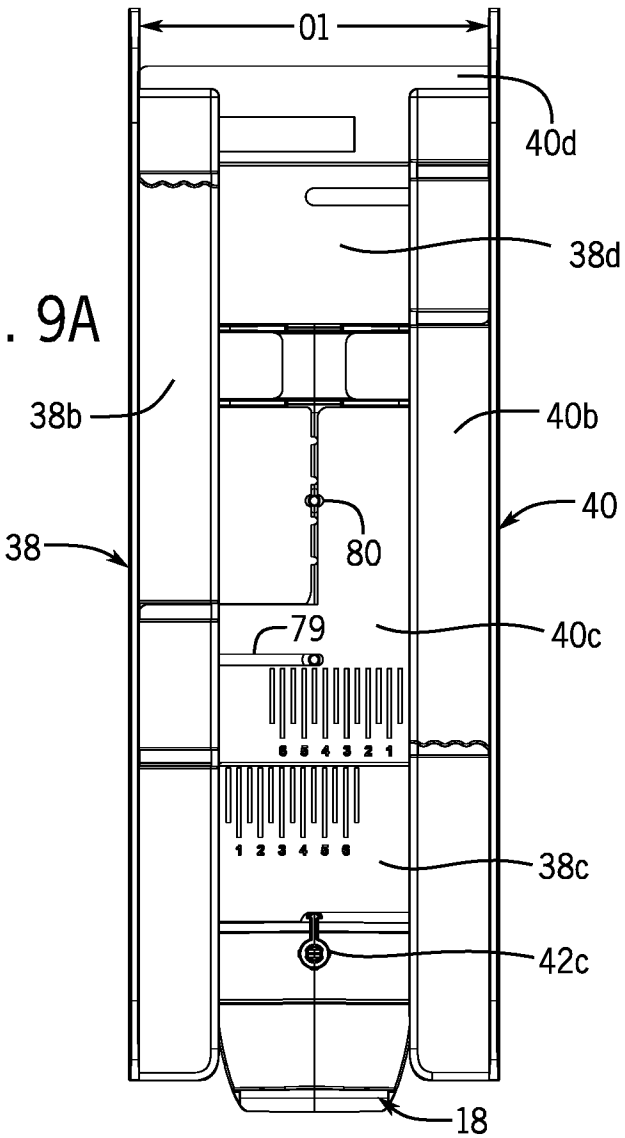
Figure 10:
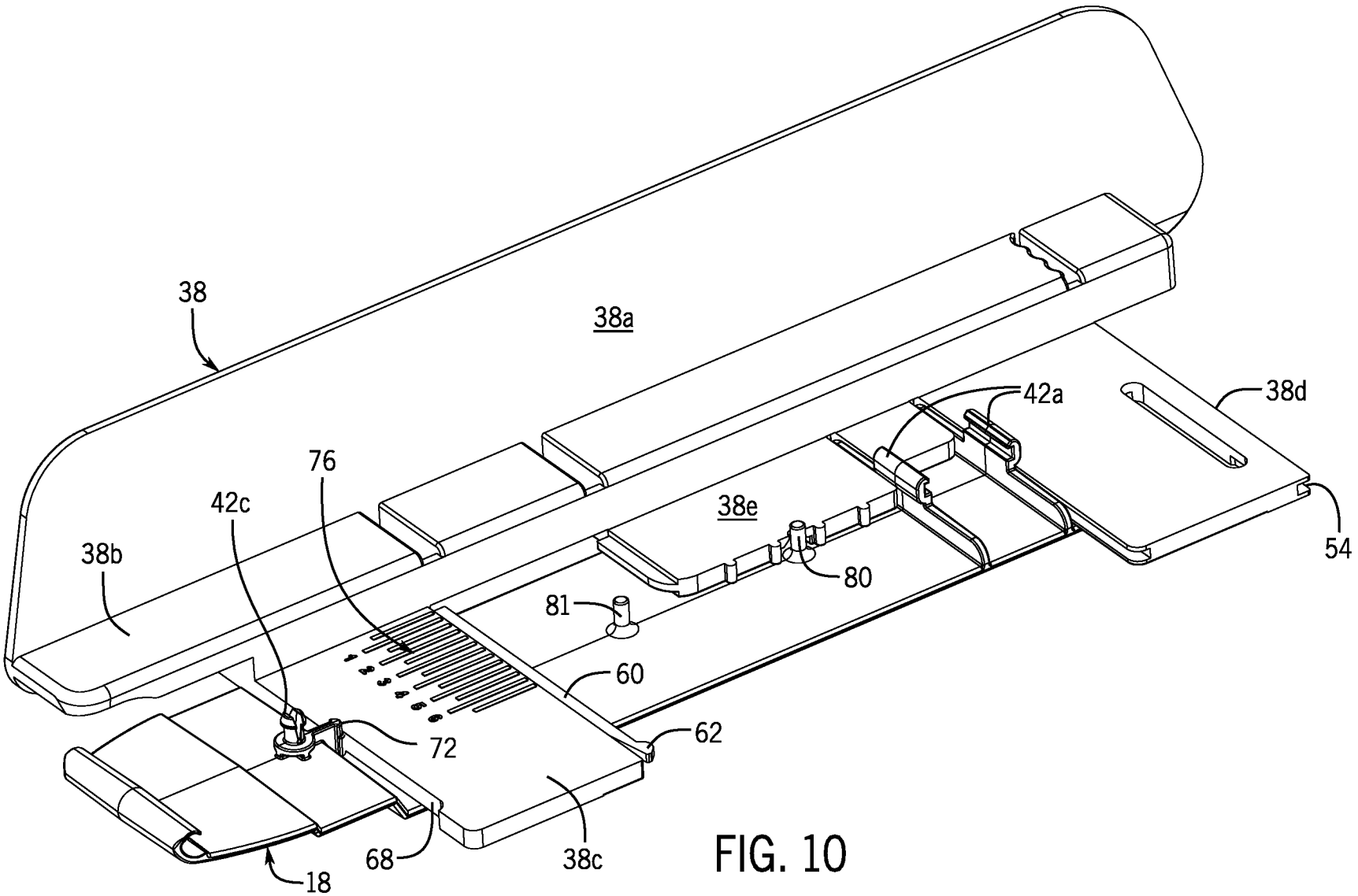
FIG. 10 is a view like FIG. 5, but with the tray subassembly of the product display merchandiser removed.
Figure 11:
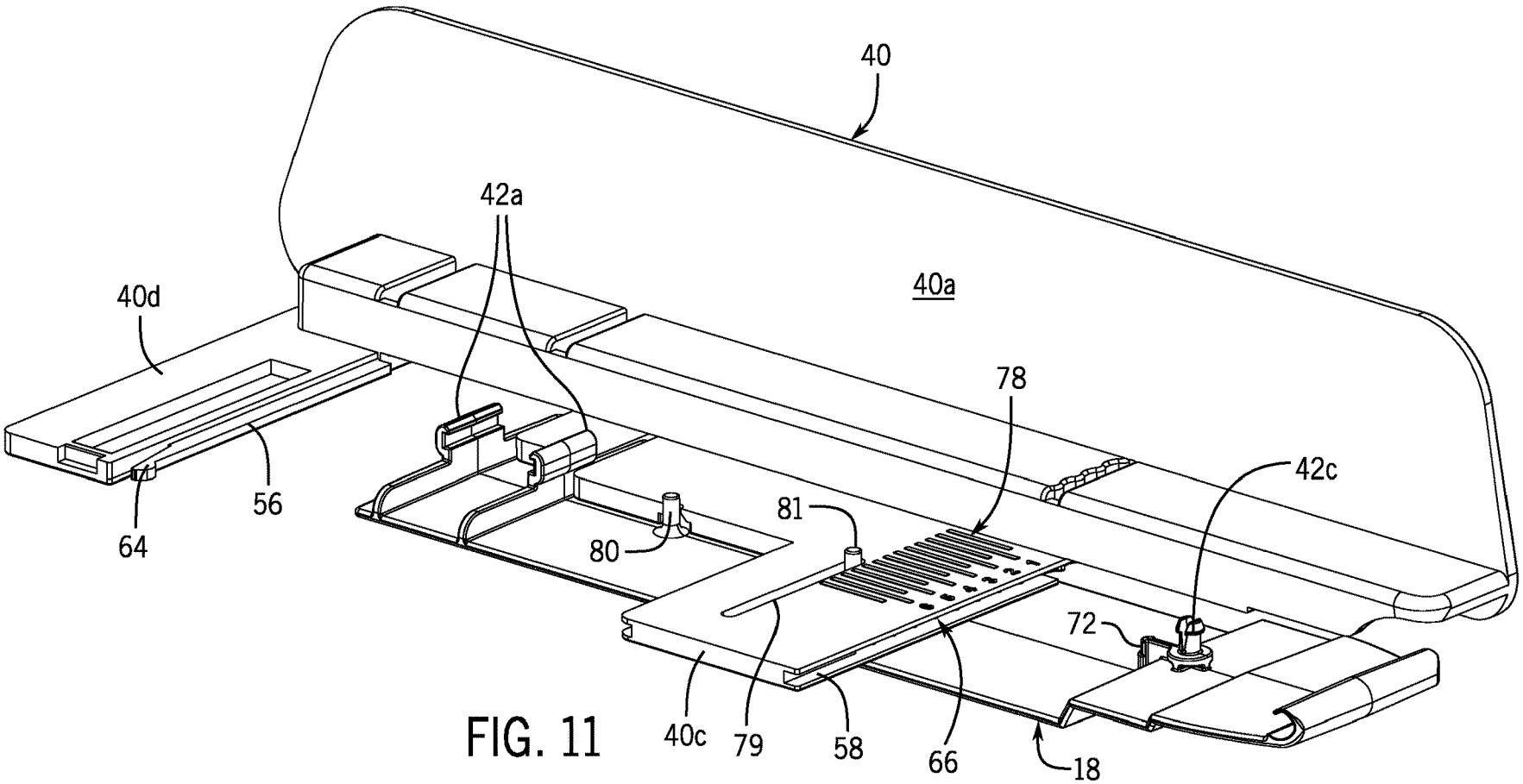
FIG. 11 is a view similar to FIG. 6, but with the tray subassembly of the product display merchandiser removed.

FIGS. 9A and 9B show the sidewalls 38, 40 in different positions with respect to the base subassembly 18. In FIG. 9A, both sidewalls 38, 40 are pushed fully towards one another and an opening O1 between the sidewalls 38, 40 is centered on the base subassembly 18. Referring also to FIGS. 10 and 11, movement of the sidewalls 38, 40 with respect to one another and with respect to the base subassembly 18 is facilitated by a flange 60, which extends from a rear side of the first horizontally projecting tab 38*c* of the first sidewall 38, and which is slidably received within a slot 58 located in the front side of the second horizontally projecting tab 40*c* of the second sidewall 40. A flange 56, which extends from a front side of the first horizontally projecting tab 40*d* of the second sidewall 40, is slidably received within a slot 54 located in a rear side of the second horizontally projecting tab 38*d* of the first sidewall 38. The first sidewall 38 and the second sidewall 40 are adjustably positionable relative to each other, and FIG. 9B shows both sidewalls 38, 40 pulled fully away from one another by way of the flanges 56, 60 sliding within slots 54, 58. Again, the opening O2 between the sidewalls 38, 40 is centered on the base subassembly 18. Note that although the series shown in FIGS. 9A and 9B shows the two sidewalls 38, 40 being pulled out simultaneously, in other examples, the left sidewall 38 could be pulled out first or the right sidewall 40 could be pulled out first.

In order to precisely position the sidewalls 38, 40 of the sidewall subassembly 16 with respect to one another and with respect to the base subassembly 18, the assemblies are provided with detent-like mechanisms in the form of a number of projections and scalloped surfaces. A portion of the horizontally projecting tab 38*c* of the first sidewall 38 slidably interfaces with a portion of the horizontally projecting tab 40*c* of the second sidewall 40 such that the vertical portions 38*a*, 40*a* of the first and second sidewalls 38, 40 are laterally adjustable relative to one another and the base plate 42. More specifically, the portion of the horizontally projecting tab 38*c* of the first sidewall 38 is a projection coupled to the horizontally projecting tab 38*c* of the first sidewall 38, and the portion of the horizontally projecting tab 40*c* of the second sidewall 40 is a scalloped surface formed in the horizontally projecting tab 40*c* of the second sidewall 40. Referring again to FIGS. 10 and 11, it can be seen that flanges 56 and 60 separate from the side surfaces of horizontally projecting tabs 40*d* and 38*c*, respectively, to effectively become spring-loaded. Projection 62, 64 are located at the ends of the flanges 56, 60 extending from the side surfaces of the horizontally projecting tabs 38*c*, 40*d* of the first sidewall 38 and second sidewall 40, respectively. The projections 62, 64 at the end of these flanges 56, 60 ride along scalloped surfaces within their corresponding slots 54, 58 in the side surfaces of the horizontally projecting tabs 38*d*, 40*c*, respectively. Such a scalloped surface 66 is shown in slot 58 in FIG. 11. Although the scalloped surface is not shown in slot 54, it should be understood that it is identical to the scalloped surface 66.

Thus, each of the flanges 60, 56 extending from the first horizontally projecting tabs 38*c*, 40*d* of the first sidewall 38 and the second sidewall 40 terminates in a projection 62, 64 such that the projection 62 of the first horizontally projecting tab 38*c* of the first sidewall 38 interacts with the scalloped surface 66 of the second horizontally projecting tab 40*c* of the second sidewall 40 and the projection 64 of the first horizontally projecting tab 40*d* of the second sidewall 40 interacts with the scalloped surface (not shown, inside slot 54) of the second horizontally projecting tab 38*d* of the first sidewall 38. The interaction of projections 62, 64 with scalloped surfaces 66 inside slot 58 and scalloped surfaces (not shown) inside slot 54 provides a number of discrete detents that allow the user to precisely position the horizontally projecting tabs 38*c*, 38*d*, 40*c*, 40*d* with respect to one another and with respect to the base subassembly 18. In fact, at least one of the horizontally projecting tabs 38*c*, 38*d*, 40*c*, 40*d* includes a plurality of indicator markings 76, 78 that enable a user to move the first sidewall 38 and the second sidewall 40 to define a plurality of discrete tray widths, such that an opening O1, O2 between the first sidewall 38 and the second sidewall 40 is centered relative to a longitudinal midline of the base plate 42. Here, both horizontally projecting tabs 38*c* and 40*c* are provided with a series of markings 76, 78, respectively, (such as numbers and hatch marks) that allow the user to position the sidewalls 38, 40 at precise distances away from one another, thereby creating an opening between the sidewalls 38, 40 that matches the width of a particular product. Note that opening widths between the fully closed opening O1 and the fully open opening O2 are possible, although not shown herein.

Still referring to FIGS. 9A-11, it should be understood that while the above description has focused on widening the opening between the sidewalls 38, 40 by pulling them away from one another, the opening between the sidewalls 38, 40 can also be narrowed by pushing them toward one another. In the event that only one of the sidewalls 38 or 40 is pushed in towards the base subassembly 18 at a time (although both sidewalls 38, 40 can be moved at the same time, as described herein above), a peg 80 extending upwardly from base plate 42 of base subassembly 18 limits over-travel of the sidewall 38 or 40. Furthermore, at least one of the horizontally projecting tabs 38*c*, 38*d*, 40*c*, 40*d* further comprises a notch configured to engage with the peg 80 to prevent an over-travel condition of at least one of the first and second sidewalls 38, 40 with respect to the base plate 42. Referring to FIGS. 9A and 9B, a notch 82 on tab 38*e* and a notch 84 on horizontally projecting tab 40*c* fit around the peg 80 and prevent further movement of the respective sidewall 38 or 40 in an inward direction. FIGS. 10 and 11 show the sidewalls 38 and 40 at the end of their inward travel and touching the peg 80, so these notches 82, 84 are not particularly visible. Additionally, front side surface 68 of horizontally projecting tab 38*c* interacts with a projection 72 on the base subassembly 18 behind clip 42*c*. A slot 79 in horizontally projecting tab 40*c* fits around a peg 81 also projecting upwardly from the base subassembly 18. Both of these additional features also limit over-travel of the sidewalls 38, 40, as well as maintain the sidewalls 38, 40 aligned with the base plate 42 and one another.

The product display merchandiser width-adjustment mechanism described herein therefore includes two sidewalls 38, 40 with horizontal portions (i.e., horizontally projecting tabs 38*c*, 38*d*, 40*c*, 40*d*) that slidably interlock with each other and with a rack (formed by projection 72 and peg 81) on a third component, here, base subassembly 18. As the sidewalls 38, 40 are pulled out, they adjust in relation to each other and in relation to the third component. When the third component (the base subassembly 18) is connected to or integrated with the pusher subassembly 12 and centered on the mid-line, the sidewalls 38, 40 therefore adjust in equal relation to the product display merchandiser mid-line.

Because the sidewalls 38 and 40 have horizontally projecting tabs 38*c*, 38*d*, 40*c*, 40*d* that interengage, the sidewalls 38, 40 of the product display merchandiser 10 are able to be sub-assembled as a pair that can then later be attached to a pusher subassembly 12. This is valuable in the manufacturing process of the product display merchandiser 10 because the components can be sub-assembled in one location or station and then assembled to the pusher subassembly 12 and the remainder of the product display merchandiser 10 at a second location or station. This is an improvement over known designs that require the sidewalls and pusher body parts be assembled together at one station. Mixed supply chain models can be utilized that locate some assembly steps in a lower-wage region or with a lower-cost vendor, while the finished goods are assembled in other areas. Additionally, if the sidewall subassemblies 16 are common components used with multiple finished goods SKUs, they can be warehoused as a sub-component to be used for the various finished goods.

Figure 12:
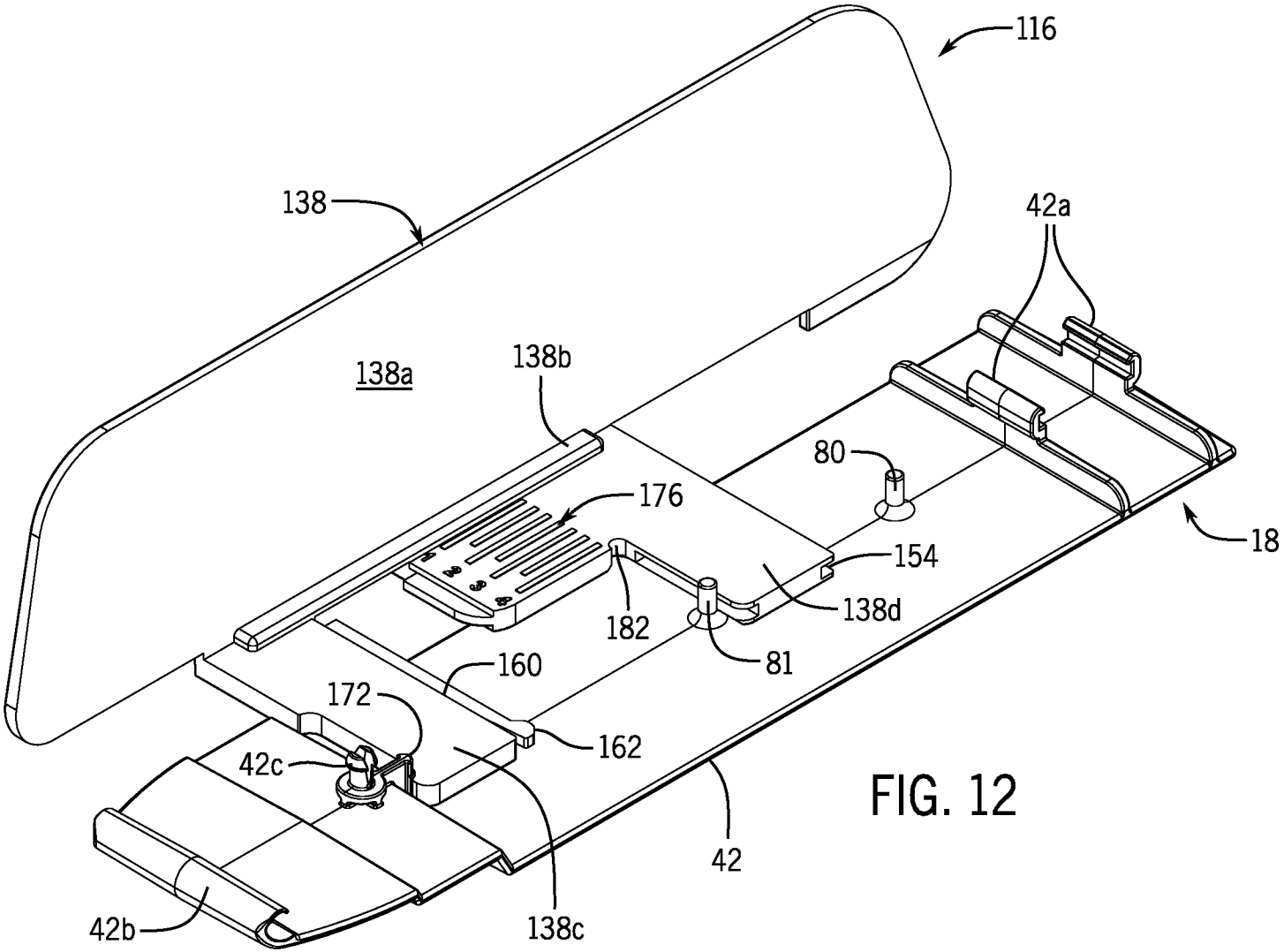
FIG. 12 illustrates a first sidewall and a base plate of another embodiment of a product display merchandiser.
Figure 13:
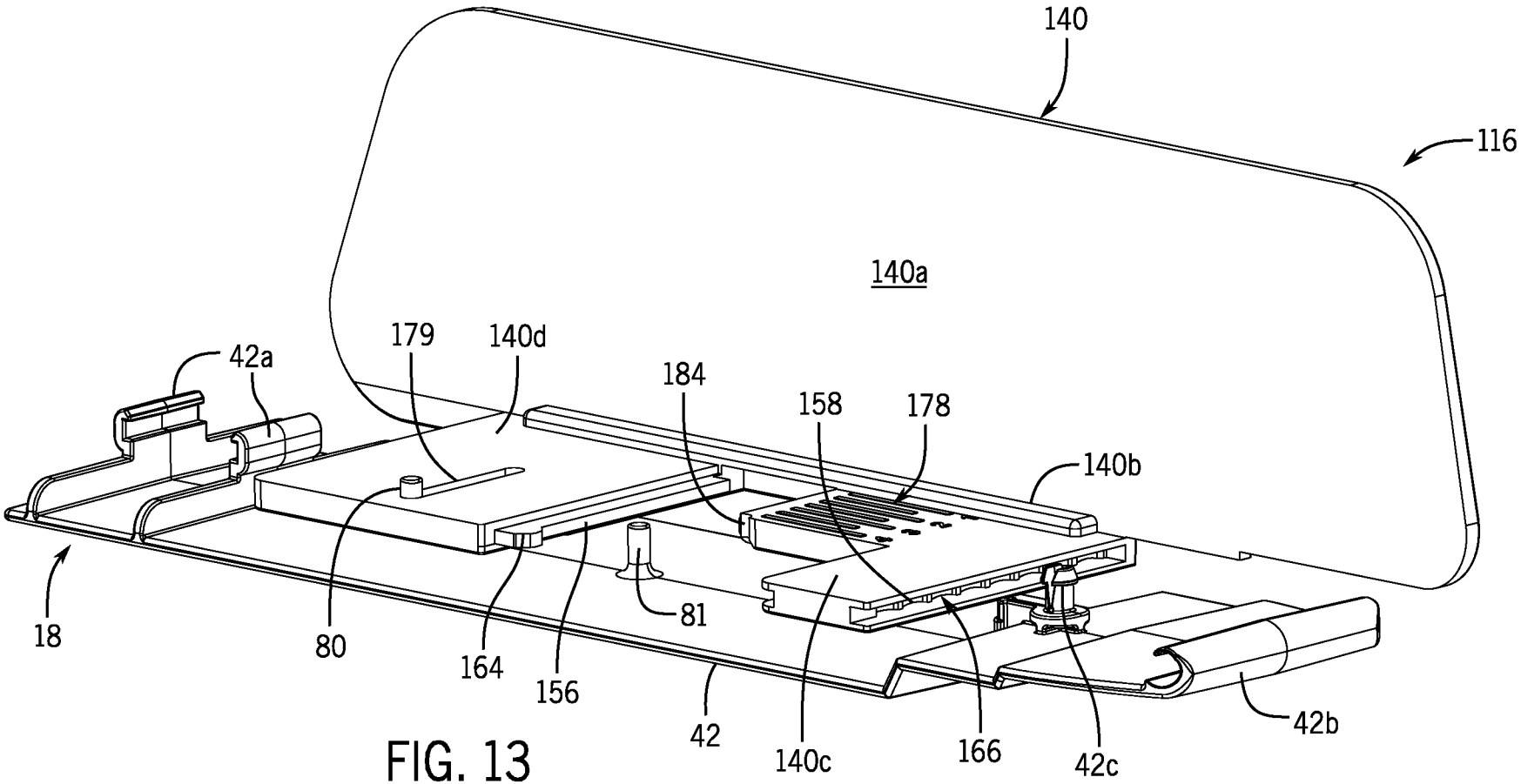
FIG. 13 illustrates a second sidewall and the base plate of the embodiment of FIG. 12.

FIGS. 12 and 13 show a second embodiment of a sidewall subassembly 116 on the same base subassembly 18 as in FIGS. 1-11. Note that all elements not specifically described herein below with respect to the second embodiment of the sidewall subassembly 116 are denoted with a 3-digit reference number starting with "1," and these elements correspond to the like-numbered elements in the first embodiment of product display merchandiser 10. There are two key differences between the sidewall subassembly 16 and the sidewall subassembly 116.

First, the sidewall subassembly 116 of FIGS. 12 and 13 includes a minimal horizontal product-supporting portion on each of the sidewalls 138, 140. It can be seen, for instance, that horizontal product-supporting portions 138*b*, 140*b* of sidewalls 138, 140, respectively, are narrow ledges at the bottom edge of the vertical portions 138*a*, 140*a*. This can allow for a product display merchandiser with the sidewall subassembly 116 to be used with narrow products and/or when tight horizontal pack-out is desired. As in the first embodiment, the sidewalls 138, 140 are laterally adjustable to change the width of the product display merchandiser, but the minimum width is less than that when the first embodiment of the sidewall subassembly 16 is used. In other embodiments, no horizontal product-supporting portion is provided at all on the sidewalls.

Second, the horizontally projecting tabs 138*c*, 138*d* on sidewall 138 and 140*c*, 140*d* on sidewall 140 are located and shaped differently than those of the first embodiment of the sidewall subassembly 16. However, the function of the components is similar, in that projection 162 on flange 160 on horizontally projecting tab 138*c* fits into slot 158 with scalloped surface 166 on horizontally projecting tab 140*c*, while projection 164 on flange 156 on tab 140*d* fits into slot 154 with scalloped surface (not shown) on horizontally projecting tab 138*d*. In this example, each of the second horizontally projecting tabs 138*d*, 140*c* of the first sidewall and the second sidewall 138, 140 is substantially L-shaped in plan view, and the two horizontally projecting tabs 138*d*, 140*c* with notches 182, 184 slot together around the peg 81 that limits over-travel of the sidewalls 138, 140. A slot 179 in tab 140*d* fits around peg 80 also to limit over-travel, while ensuring that the sidewall 140 remains aligned on the base plate 42.

Note that the same base plate 42 is used with both the first and second embodiments of the sidewall subassembly 16, 116. This makes manufacturing of the parts easier, as different base subassemblies do not need to be manufactured for different sidewall subassemblies. In one example, the sidewall subassembly 16 of FIGS. 1-11 is used on a product display merchandiser that is longer than the product display merchandiser with which the sidewall subassembly 116 of FIGS. 12 and 13 would be used. The pusher subassembly 12 and the support subassembly 14 may be modified to be shorter or longer as required depending on the length of the product display merchandiser (see FIG. 14).

Additionally, note that although the pusher subassembly 12, support subassembly 14, sidewall subassemblies 16, 116, and base subassembly 18 are described for use with a product display merchandiser 10 that is designed for suspension from a peg board or slat, the sidewall subassemblies 16, 116 could instead be used with a product display merchandiser having a support bracket subassembly that is designed to be from a grid system or a horizontal bar. Thus, the description of the support subassembly 14 provided herein above is not limiting on the scope of the present disclosure. For such "suspended" embodiments, the base plate 42 has a width configured to hold a single pusher subassembly 12 thereupon.

Figure 14:
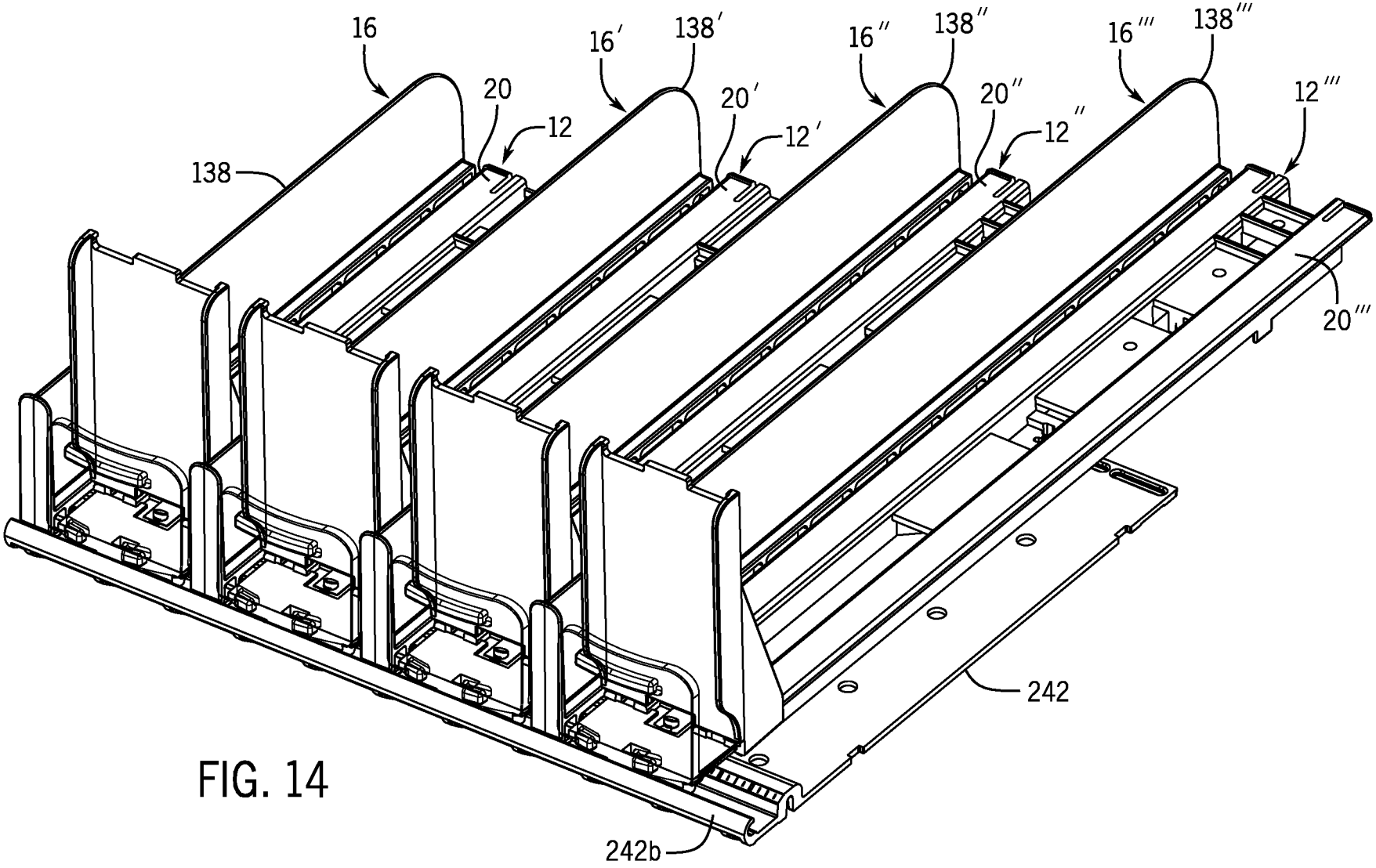
FIG. 14 illustrates several product display merchandisers on a single base plate.
Figure 15:
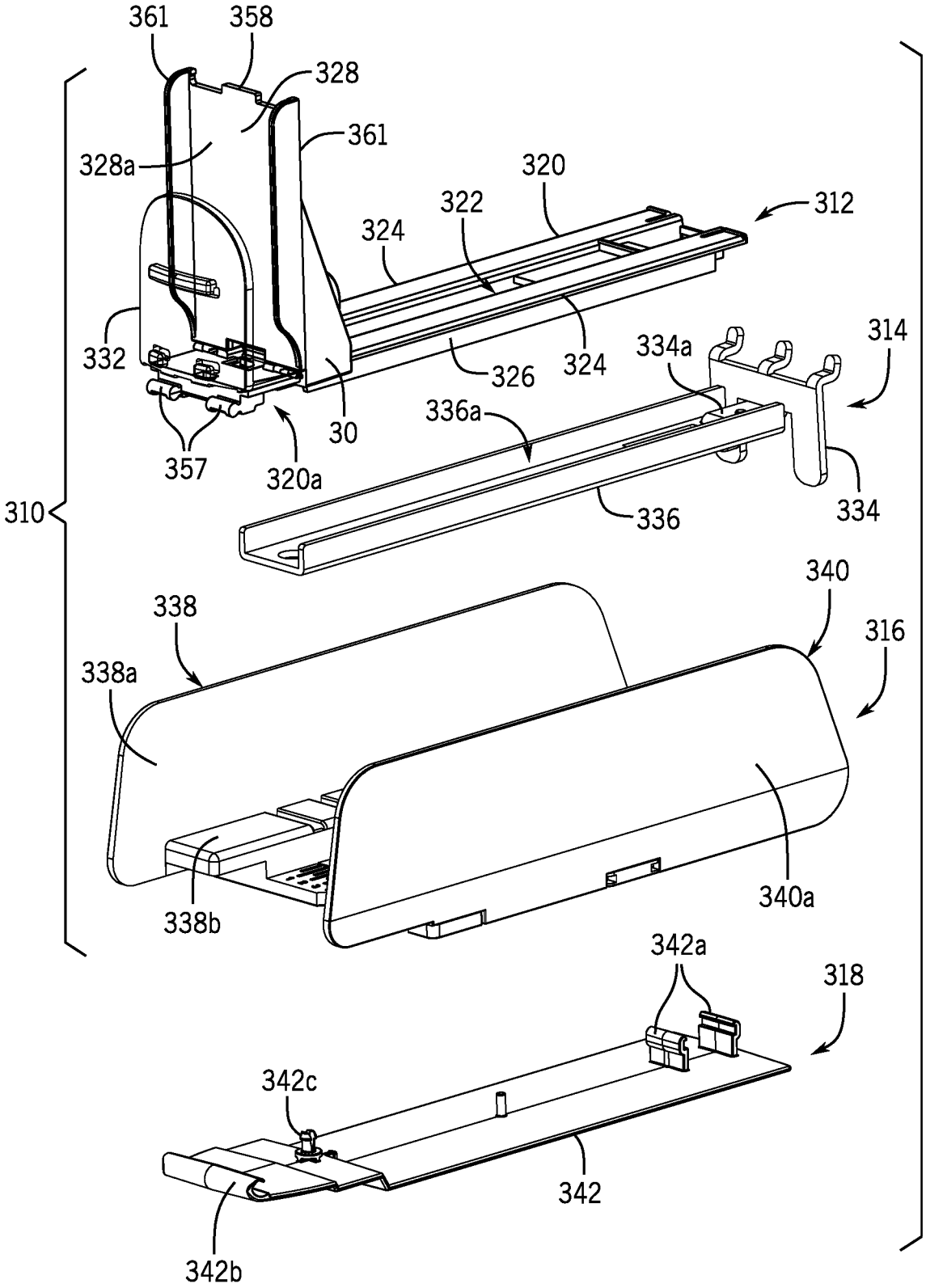
FIG. 15 illustrates a partially exploded view of another embodiment of a product display merchandiser.

In other embodiments, however, the pusher subassembly 12 and sidewall subassemblies 16, 116 can be used with a product display merchandiser that is designed to sit on a shelf. Thus, the support subassembly 14 and the base subassembly 18 are removable from the product display merchandiser 10 so that the pusher subassembly 12 and the sidewall subassembly 16, 116 can be coupled to a shelf-supported base plate. For example, FIG. 14 shows a plurality of product display merchandisers of different lengths as they might be arranged on a shelf. A shelf-supported base plate 242, which has a width configured to support more than one tray 20, 20', 20", 20'" is fastened to a shelf in a known manner. The shelf-supported base plate 242 has a socket 242*b* at its front end shaped like the socket 42*b* of FIGS. 1-13. The fitting 57 at the front end of each tray 20, 20', 20", 20'" fits into the socket 242*b* to hold the pusher subassemblies 12, 12', 12", 12'" to the shelf-supported base plate 242. In this example, only one sidewall 138, 138', 138", 138'" is provided for each pusher subassembly 12, 12', 12", 12'", enabling tight horizontal packout on the shelf. In other examples, two sidewalls or sidewalls with wider horizontal portions (see sidewalls 38, 40) can be provided for use with the pusher subassemblies.

FIGS. 15-18 show another embodiment of a product display merchandiser 310. In this embodiment, the base subassembly 318 and sidewall subassembly 316 are similar, if not identical to, the base subassembly 18 and sidewall subassembly 16 of FIGS. 1-13, and therefore will not be described further herein, but like components will be labeled with a 3-digit reference number starting with the numeral "3." The support subassembly 314 differs from that of the first embodiment, however. The support subassembly 314 includes a bracket 334 and a support member 336. In this example, the support member 336 is C-shaped and has a channel 336*a* that opens upwardly; however, other structural cross-sections could be used. In this example, the bracket 334 is connected to the support member 336 by way of a horizontally projecting tab 334*a*, which sits in the channel 336*a* and is bolted, riveted, or otherwise attached to the support member 336. In other examples, the bracket 334 and support member 336 could be a single, integral piece.

Figure 16:
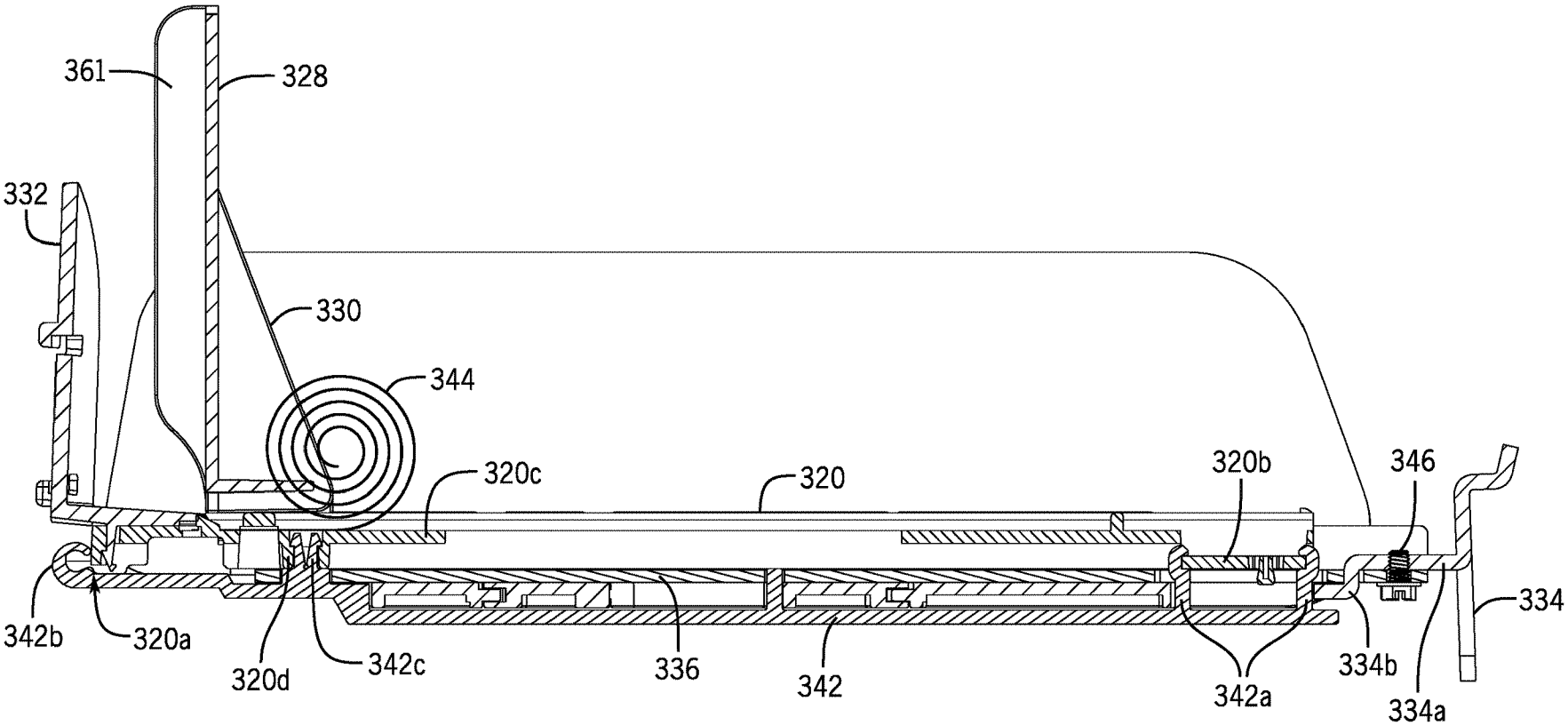
FIG. 16 is a cross-section of the product display merchandiser of FIG. 15 down a longitudinal centerline thereof, wherein no sidewalls are installed.

Referring to FIG. 16, the base plate 342 is snap-fit to the tray 320 by way of the clips 342*a* extending through openings in the support member 336 and fitting around either end of a lower wall 320*b* of the tray 320. Clip 342*c* extends through an opening in the support member 336 and fits into a receiving boss 320*d* in lower wall 320*c* of tray 320. Clips 342*a*, 342*c* thereby connect the base subassembly 318 to the support subassembly 314 and the pusher subassembly 312. Socket 342*b* receives a fitting (not shown, see 57, FIG. 8) on the front end 320*a* of tray 320, also connecting the base subassembly 318 to the pusher subassembly 312. Horizontally projecting tab 334*a* on bracket 334 includes a stepped portion 334*b* that fits through a gap in the tray 20 in order to extend thereunder. A front end of the stepped portion 334*b* abuts the rearmost clip 342*a*. Support member 336 is attached to bracket 334 by way of bolt 346.

Figure 17:
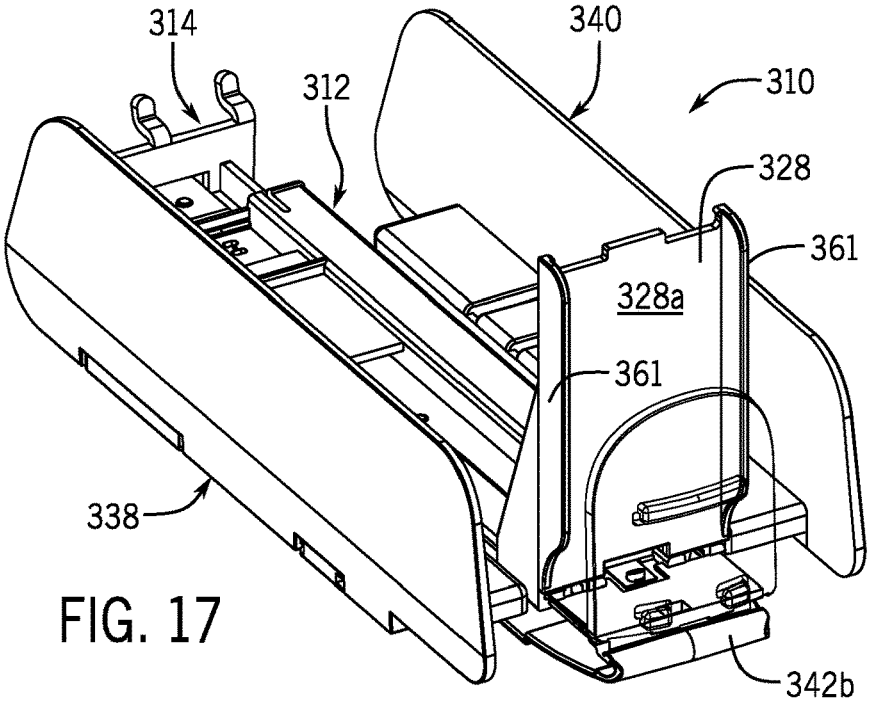
FIG. 17 is a front perspective view of the assembled product display merchandiser of FIGS. 15 and 16.
Figure 18:
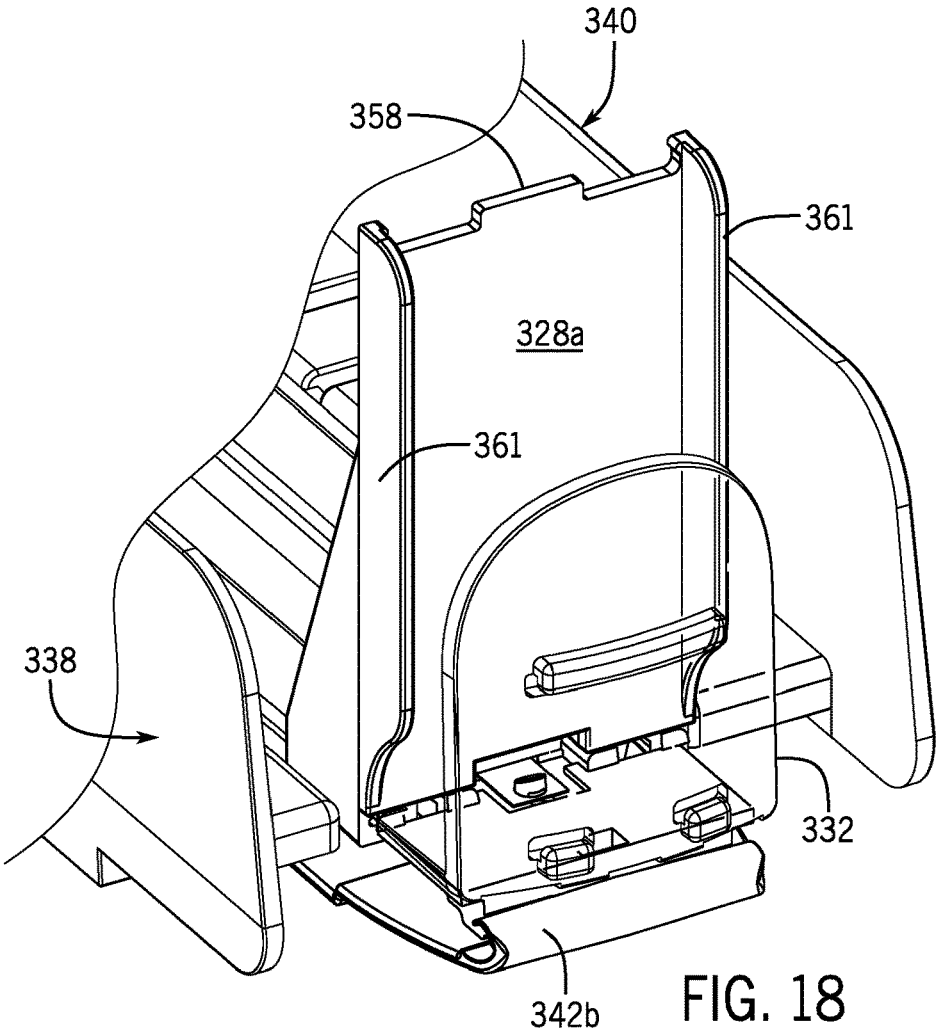
FIG. 18 is a close-up view of the front end of the product display merchandiser of FIGS. 15-17.

The pusher subassembly 312 also differs from that of the first embodiment in that the pusher 328 comprises a front product-engaging face 328*a* having ribs 361 projecting forwardly therefrom on either lateral side thereof. FIG. 17 shows the product display merchandiser 310 of FIG. 15 assembled and from a different angle in order to highlight the ribs 361 on the pusher 328. The ribs 361 extend along a majority (greater than 50%) of the height of the pusher 328, but could extend along less of the height of the pusher 328 than that shown herein. The ribs 361 extend forwardly of the front face 328*a* of the pusher 328, as shown in FIG. 18. The ribs 361 cradle or guide products and keep products centered on the front face 328*a* of the pusher 328 and standing upright. Integration of the ribs 361 into the pusher 328 simplifies over previous designs that included add-on components to pusher paddles.

Figure 19A:
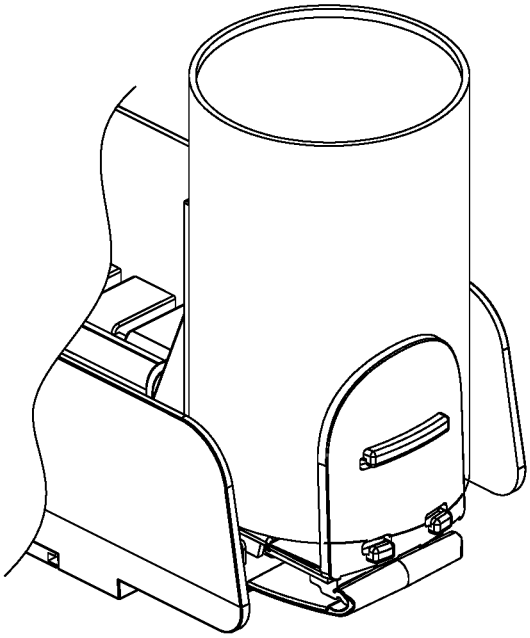
FIGS. 19A and 19B are photographs of product engaged by a pusher according to the embodiment of FIGS. 15-18.
Figure 19B:
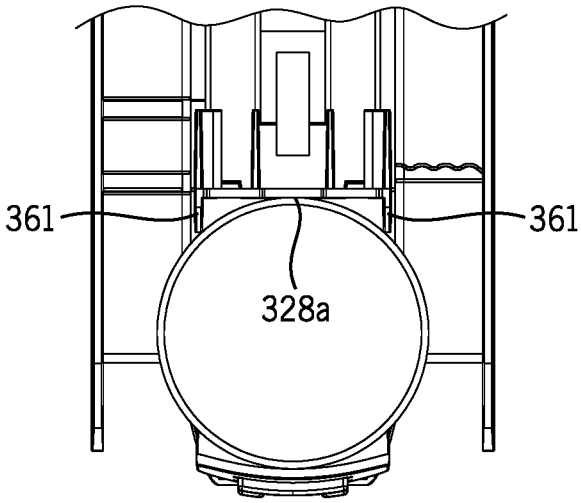
Figure 20A:
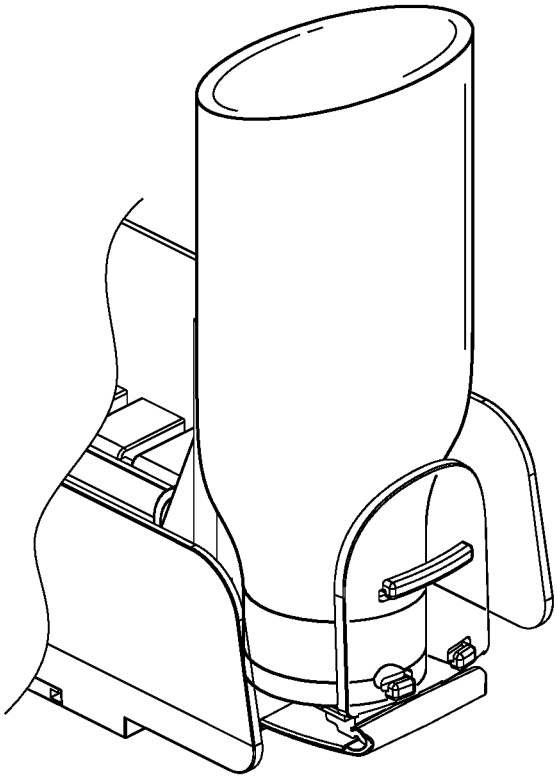
FIGS. 20A and 20B are photographs of a different product engaged by the pusher according to the embodiment of FIGS. 15-18.
Figure 20B:
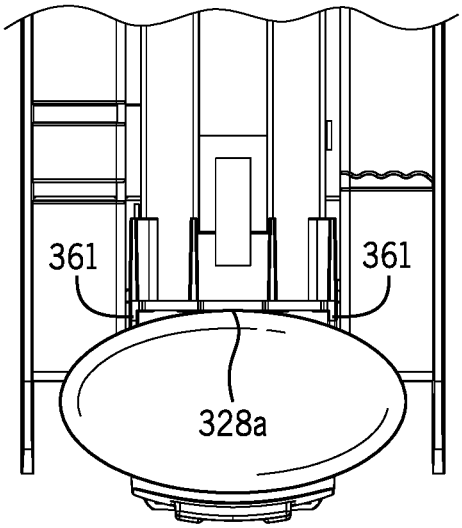

FIGS. 19A and 19B and 20A and 20B show how the ribs 361 are particularly useful when the product being pushed is cylindrical or oval, such as a can of soup or a bottle of shampoo. For a cylindrical object, as shown in FIG. 19B, three points of contact between the product and the pusher 328 are made: one at each of the ribs 361 and one on the front face 328*a* of the pusher 328. For an oval product, as shown in FIG. 20B, two points of contact, one at each of the ribs 361, are present between the product and the pusher 328. This is in contrast to prior pushers, in which only one point of contact would be made between the pusher's front face and the rounded rear surface of the oval or cylindrical product.

The ribs 361 are also particularly useful when the product being pushed is a bag with loosely packed contents, such as bagged snack candy or snack nuts. In this case, three points of contact (one at each of the ribs 361 and one on the front face 328*a* of the pusher 328) are also present between the product and the pusher 328, providing lateral stability and holding the product upright.

The pusher 328 with ribs 361 is additionally advantageous when the pusher 328 is installed on a shelf arrangement and the walls between products are fixed or low in height, as products are maintained in the center of the pusher 328 and upright.

Note that although the pusher 328 with ribs 361 is shown in the embodiment of the product display merchandiser 310 having an elongated support member 336, the pusher 328 with ribs 361 could instead by used with the product display merchandiser 10 of FIGS. 1-11, with the sidewall subassembly of either FIG. 1-11 or 12-13. Additionally, note that the pusher 28 without ribs could be used with the product display merchandiser 310 of FIGS. 15-18.

The use of subassemblies as described above for the product display merchandisers 10, 310 allows for using mixed supply chain models that locate some assembly steps in a lower-wage region or with a lower-cost vendor, after which the finished goods can be assembled in other areas. One particular advantage is realized when the sidewall subassemblies are common components across multiple finished goods SKUs, and therefore the sidewall subassemblies 16, 116 can be warehoused as a sub-component to be used for the various finished goods. For example, the sidewall subassembly 16 shown in use with the support subassembly 14 of the present disclosure, which is designed for use with a peg board, could instead be used with support brackets that connect to grid systems, or with pusher tray assemblies meant to sit on a shelf. As another example, the pusher subassembly 12 can be inserted into a system such as that described with respect to U.S. Patent Application Publication No. 2015/0157142, which is hereby incorporated herein by reference.

The mechanisms that connect the subassemblies of the present disclosure could be of alternate varieties, and could include multiple snap-fits, multiple sockets/fittings, mechanical fasteners such as screws or hook and loop (Velcro), or chemical fasteners such as glue or tape. Alternatively, a physical process such as welding or heat-staking could be used to connect the subassemblies to one another.

Once the subassemblies have been constructed and perhaps partially or fully assembled to one another, the supply chain model includes shipping the subassemblies or assembled parts to the stores in which they will be installed. Presently, this is done in packages that need large amounts of inserts and filler material to hold the products stable and safe during shipping and handling. Pairs of pushers are sometimes held together using a rubber band in order to save space while packaging. The present inventors have developed a design that allows for pairs of subassemblies or finished goods to be temporarily assembled to one another during shipping, thus saving space and allowing more units to be packaged per box.

Figure 21:
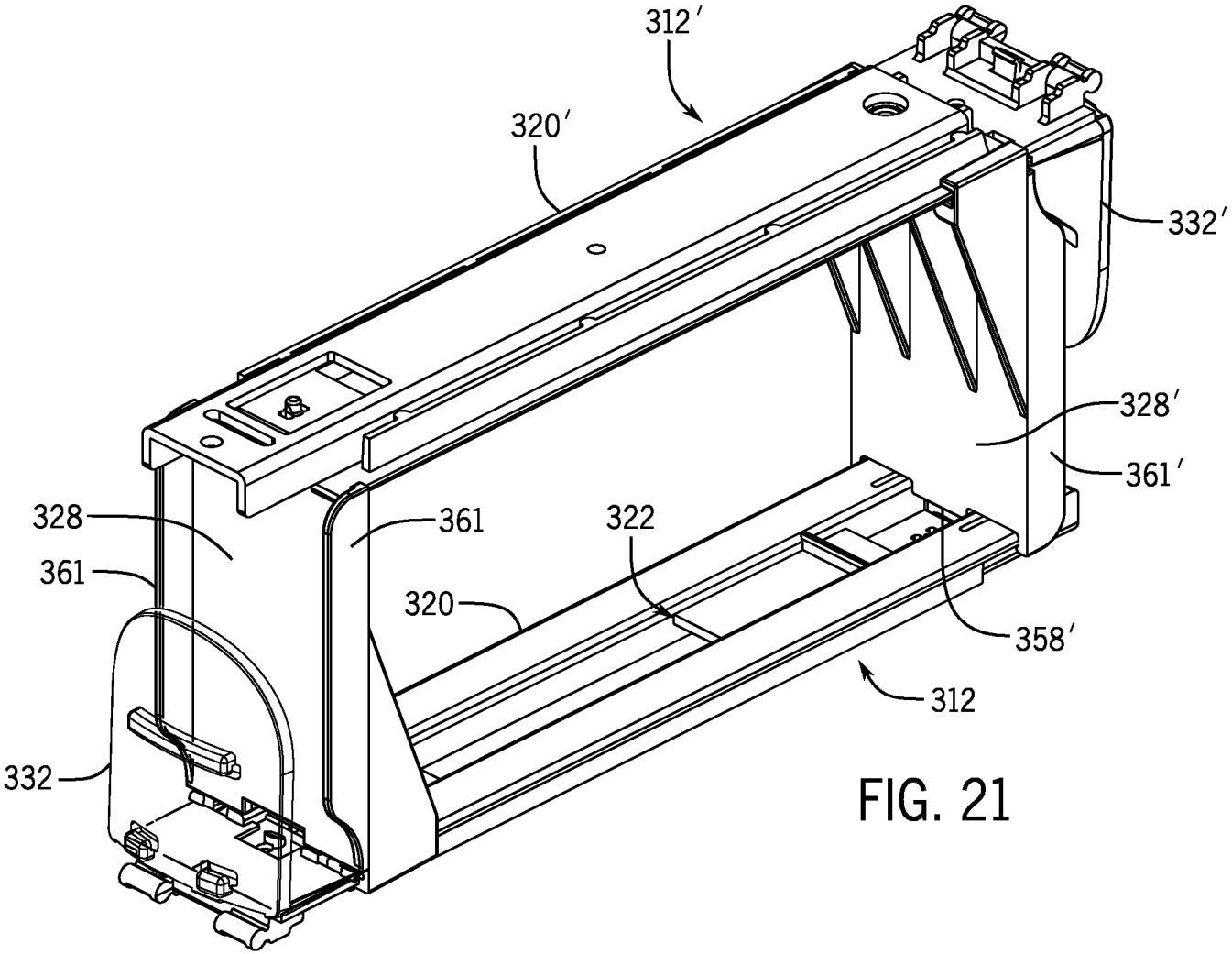
FIG. 21 shows two pusher subassemblies according to the embodiment of FIGS. 15-18 connected together for shipping.

Referring to FIG. 21, two pusher subassemblies 312 and 312' are shown temporarily connected to one another for purposes of packing and shipping. This temporary connection is made by way of orienting the pusher subassemblies 312, 312' top-to-top and front-to-back and inserting tab 358' (see FIG. 18) on pusher subassembly 312' into channel 322 of tray 320 on pusher subassembly 312. Similarly, tab 358 on pusher subassembly 312 is inserted into an identical channel (not shown) in tray 320' of pusher subassembly 312'. The tabs 358, 358' are located at the top ends of the pushers 328, 328' and are integral therewith. The top end of ribs 361, 361' fit around either side of the opposite tray 320, 320', respectively. The interaction between trays 320, 320' and the top ends of pushers 328, 328' by way of tabs 358, 358' and side ribs 361, 361' ensures a stable temporary connection between the two pusher subassemblies 312, 312' during packing and transit. Note that in other examples, only the tabs 358, 358' or only the projecting side rails 360, 360' could be provided. Additionally, note that the tabs 358, 358' and ribs 361, 361' could take shapes other than those shown herein.

The snap feature, wherein the tabs 358, 358' snap into channels 322, 322', is specifically designed to be strong enough to hold the trays 320, 320' together during shipment, but weak enough that the trays 320, 320' can be separated before installation without tools and without significant effort. The nesting track features can be included on any variety of pusher or pusher systems, not just those shown herein.

Figure 22:
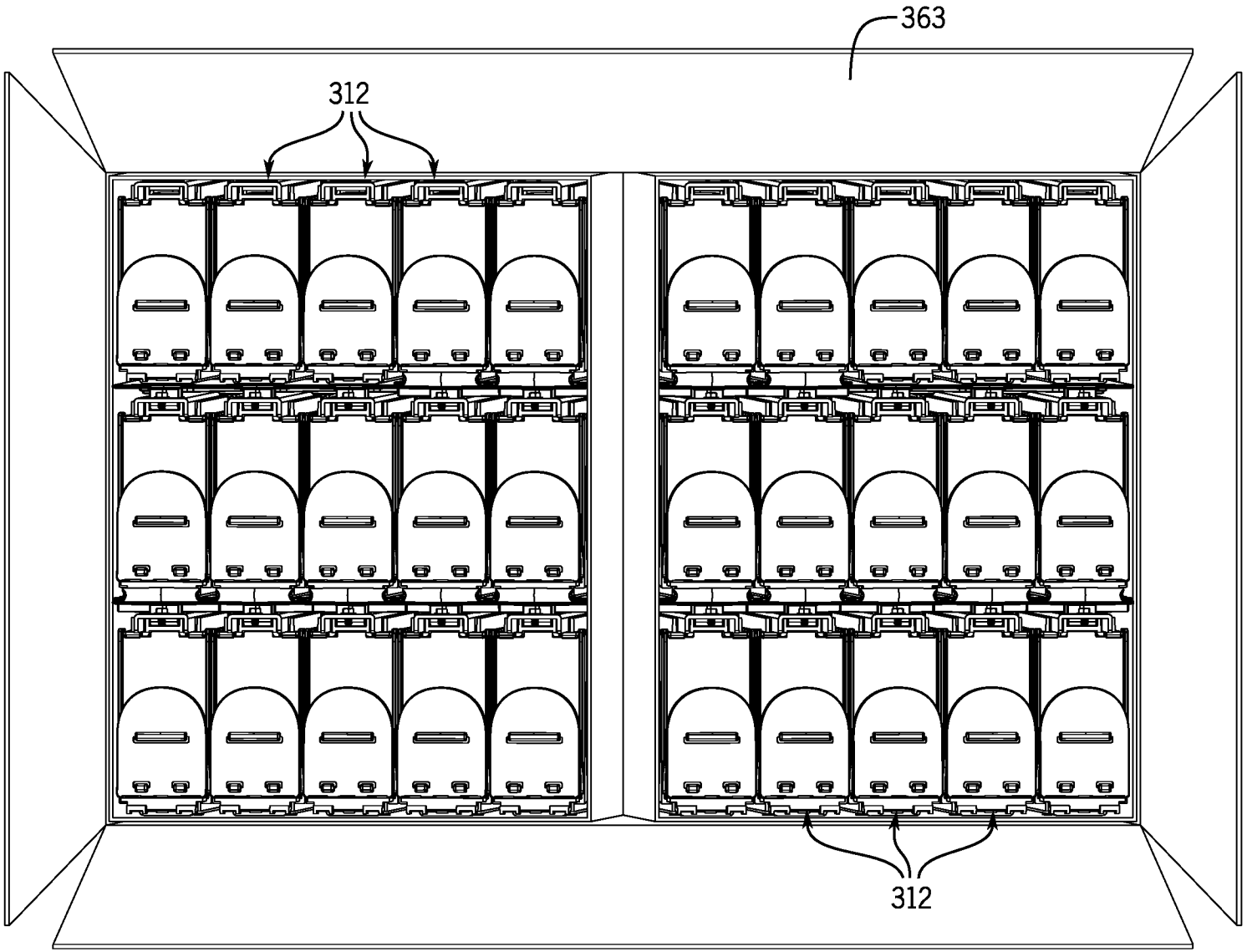
FIG. 22 shows a number of pusher subassemblies packaged in a box.

The connected pusher subassemblies 12, 12' of FIG. 21 allow packaging to be designed more efficiently and with less waste, because the pusher subassemblies or tray assemblies hold together and support each other during packing. FIG. 22 shows how a number of connected pusher tray subassembly pairs can be stored on-end in a box 363. Note that because the paired pusher tray subassemblies are connected to one another, they stay more organized during unpacking and installation, which makes installation easier and faster.

FIG. 22 shows another advantage of the modular product display merchandiser 10 of the present disclosure. Specifically, design and arrangement of the shipping box 363 that contains the modular components that make up an installation of a pusher system can be organized in sections so that kit-packers or installers can access each section without having to move items out of the way. This is useful in kitting so that items for each section can be loaded and counted one at a time for improved packing speed and accuracy. This is also useful for unpacking because the installer can get parts from one section, then the next section, then the next section, and so on. The installer will do this for each assembly they are installing, one at a time, until the box 363 is empty.

The height of the box 363 is approximately slightly taller than the longest components included as part of the kit. This enables easy packing and reaching of the components without having to bend over excessively to reach inside the box 363. The box footprint is arranged in proportions where one side is about half as long as the other side, so that the box 363 can be easily set in the aisle of a small retail store, while still allowing room to work and move around the box 363. Previous box designs caused interference in the retail aisle due to their width. The box 363 may also include handles and a width small enough to make lifting of the box 363 ergonomic and easy for the average user.

In the present description, certain terms have been used for brevity, clarity, and understanding. No unnecessary limitations are to be implied therefrom beyond the requirement of the prior art because such terms are used for descriptive purposes only and are intended to be broadly construed. The different parts and assemblies described herein may be used alone or in combination with other parts and assemblies. Various equivalents, alternatives, and modifications are possible within the scope of the appended claims.

What is claimed is:

1. A product display merchandiser comprising:

a tray having a top product-supporting surface with a longitudinally extending channel defined therein; and a first sidewall and a second sidewall, each sidewall having a vertical portion and a horizontal portion, at least a laterally inner part of each horizontal portion configured to slide laterally with respect to the tray between a bottom of the tray and a base plate below the tray;

wherein the horizontal portions of each of the first and second sidewalls are directly slidably interlocked with one another;

wherein a front end of the tray comprises a fitting configured to be received in a socket in the base plate;

wherein at a rear end of the tray, the channel is configured to receive a removable support assembly configured to couple the tray to a support structure; and wherein the tray is configured either to be suspended from the support structure via the support assembly, with the base plate attached to an underside of the tray, or to be supported along the underside of the tray by a shelf-supported base plate, with the support assembly not assembled within the channel.

2. The product display merchandiser of claim 1, further comprising the base plate, wherein the base plate comprises upwardly projecting clips for engaging receiving structures in the tray.

3. The product display merchandiser of claim 1, further comprising the base plate, wherein the base plate has a width configured to support a single tray thereupon.

4. The product display merchandiser of claim 1, further comprising the base plate, wherein the base plate has a width configured to support more than one tray thereupon.

5. The product display merchandiser of claim 1, further comprising the support assembly, wherein the support assembly comprises a longitudinally extending support member configured to be received in the channel of the tray and a bracket extending non-parallel to the support member and configured to connect to the support structure.

6. The product display merchandiser of claim 1, further comprising a spring-biased pusher longitudinally slidable along the tray and configured to push product toward a product stop located at the front end of the tray.

7. The product display merchandiser of claim 6, wherein the pusher comprises a front product-engaging face having ribs projecting forwardly therefrom on either lateral side thereof.

8. The product display merchandiser of claim 1, wherein when the first sidewall is coupled to the tray, a laterally outer part of the horizontal portion of the first sidewall is level with the product-supporting surface of the tray.

9. The product display merchandiser of claim 1, further comprising ribs extending laterally within and across the channel in the tray, the ribs configured to be coupled to the support assembly when the support assembly is received in the channel.

10. A product display merchandiser comprising:

a tray subassembly comprising a tray having a top product-supporting surface and a longitudinally extending channel recessed from the product-supporting surface;

a base plate coupled to a bottom of the tray subassembly;

a sidewall subassembly comprising first and second sidewalls, each sidewall having a vertical portion and a horizontal portion, at least a laterally inner part of each horizontal portion slidably extending between the bottom of the tray subassembly and a top of the base plate, wherein the horizontal portions of each of the first and second sidewalls are directly slidably interlocked with one another; and a support subassembly configured to couple the product display merchandiser to a support structure, the support subassembly comprising a support member located within the channel of the tray and a bracket, wherein the support subassembly is removable from the product display merchandiser.

11. The product display merchandiser of claim 10, wherein the tray subassembly comprises a spring-biased pusher longitudinally slidable with respect to the product-supporting surface of the tray and configured to push product toward a product stop located at a front end of the tray.

12. The product display merchandiser of claim 11, wherein the pusher comprises a front product-engaging face having ribs projecting forwardly therefrom on either lateral side thereof.

13. The product display merchandiser of claim 10, wherein the base plate comprises a socket at a front end thereof, the socket configured to receive a fitting at a front end of the tray.

14. The product display merchandiser of claim 10, wherein the base plate has a width configured to hold a single tray subassembly thereupon.

15. The product display merchandiser of claim 10, wherein the base plate comprises clips projecting upwardly from the top thereof, the clips configured to engage receiving structures in the tray.

16. The product display merchandiser of claim 10, wherein laterally outer parts of the horizontal portions of each of the first and second sidewalls are level with the product-supporting surface of the tray.

17. The product display merchandiser of claim 10, wherein the base plate is removable from the product display merchandiser so that the tray subassembly and the sidewall subassembly can be coupled to a shelf-supported base plate.

18. The product display merchandiser of claim 10, further comprising ribs extending laterally within and across the channel in the tray, the ribs configured to be coupled to the support member when the support member is located in the channel of the tray.

* * * * *